US011535033B2

(12) United States Patent
Tanaka et al.

(10) Patent No.: US 11,535,033 B2
(45) Date of Patent: Dec. 27, 2022

(54) LIQUID DISCHARGE HEAD HAVING A COMMON FLOW CHANNEL AND A PLURALITY OF INDIVIDUAL FLOW CHANNELS, AND LIQUID DISCHARGE DEVICE HAVING THE LIQUID DISCHARGE HEAD

(71) Applicant: Brother Kogyo Kabushiki Kaisha, Nagoya (JP)

(72) Inventors: Taiki Tanaka, Yokkaichi (JP); Toru Kakiuchi, Chita-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/132,307

(22) Filed: Dec. 23, 2020

(65) Prior Publication Data

US 2021/0197565 A1 Jul. 1, 2021

(30) Foreign Application Priority Data

Dec. 26, 2019 (JP) ..... JP2019-235694

(51) Int. Cl.
*B41J 2/14* (2006.01)
*B41J 2/045* (2006.01)

(52) U.S. Cl.
CPC ..... *B41J 2/14201* (2013.01); *B41J 2/04541* (2013.01); *B41J 2/04581* (2013.01); *B41J 2002/14419* (2013.01)

(58) Field of Classification Search
CPC ..... B41J 2/14201; B41J 2/04541; B41J 2/04581; B41J 2002/14419;
(Continued)

(56) References Cited

U.S. PATENT DOCUMENTS

2014/0078225 A1 3/2014 Park et al.
2015/0091983 A1* 4/2015 Kakiuchi ..... B41J 2/14274 29/25.35

(Continued)

FOREIGN PATENT DOCUMENTS

JP H05-309835 A 11/1993
JP 2014-061696 A 4/2014

(Continued)

OTHER PUBLICATIONS

IP.com search (Year: 2022).*

*Primary Examiner* — Lisa Solomon
(74) *Attorney, Agent, or Firm* — Banner & Witcoff, Ltd.

(57) ABSTRACT

A liquid discharge head includes a common flow channel extending along a first direction, and individual flow channels arranged along the first direction. Each individual flow channel includes a first pressure chamber and a second pressure chamber arranged along the first direction, each of which communicates with the common flow channel, a nozzle located away from the first and second pressure chambers in a second direction orthogonal to the first direction, and a connection flow channel connecting the first pressure chamber, the second pressure chamber, and the nozzle with each other. One end of the connection flow channel in the second direction communicates with the first pressure chamber and the second pressure chamber, and the other end thereof in the second direction communicates with the nozzle. The connection flow channel extends along the second direction from the one end to the other end thereof in the second direction.

26 Claims, 11 Drawing Sheets

(58) Field of Classification Search
CPC .... B41J 2002/14338; B41J 2002/14491; B41J 2/14233
See application file for complete search history.

(56) References Cited

U.S. PATENT DOCUMENTS

| | | | |
|---|---|---|---|
| 2018/0287046 | A1 | 10/2018 | Hirai et al. |
| 2019/0329559 | A1 | 10/2019 | Ozawa |

FOREIGN PATENT DOCUMENTS

| | | | |
|---|---|---|---|
| JP | 2018-103418 | A | 7/2018 |
| JP | 2018-167576 | A | 11/2018 |

* cited by examiner

LIQUID DISCHARGE HEAD HAVING A COMMON FLOW CHANNEL AND A PLURALITY OF INDIVIDUAL FLOW CHANNELS, AND LIQUID DISCHARGE DEVICE HAVING THE LIQUID DISCHARGE HEAD

CROSS-REFERENCE TO RELATED APPLICATION

This application claims priority under 35 U.S.C. § 119 from Japanese Patent Application No. 2019-235694 filed on Dec. 26, 2019. The entire subject matter of the application is incorporated herein by reference.

BACKGROUND

Technical Field

Aspects of the present disclosure are related to a liquid discharge head having a common flow channel and a plurality of individual flow channels, and a liquid discharge device having the liquid discharge head.

Related Art

A technology has been known in which a liquid discharge head (e.g., a recording head) has a common flow channel (e.g., a common liquid chamber), and a plurality of individual flow channels each of which includes, for instance, a pressure chamber, a nozzle, and a nozzle communication port (i.e., a connection flow channel). In this technology, the plurality of individual flow channels are arranged so densely as to achieve high-resolution image formation.

SUMMARY

In the known technology, since the plurality of individual flow channels are arranged highly densely, each pressure chamber is too small in width to allow some types of liquid (e.g., high-viscosity ink, special glossy ink, etc.) requiring a high discharge pressure to be stably discharged.

In order to stably discharge the above types of liquid, the discharge pressure may be made higher by reducing the resolution and enlarging the width of each pressure chamber to increase a deformable amount of each actuator of the recording head. In this case, however, the enlarged width of each pressure chamber results in a higher mechanical compliance of the corresponding actuator defining each pressure chamber, thereby causing a longer AL ("AL" is abbreviation for "Acoustic Length" representing a one-way propagation time of a pressure wave in the individual flow channel). A longer AL makes it more difficult for the liquid to be discharged at a high frequency. In particular, this problem may be more pronounced as each of the actuators (e.g., piezoelectric elements) has a smaller thickness.

Aspects of the present disclosure are advantageous to provide one or more improved techniques that make it possible for a liquid discharge head to stably discharge a type of liquid requiring a high discharge pressure, at a high frequency.

According to aspects of the present disclosure, a liquid discharge head is provided, which includes a common flow channel extending along a first direction, and a plurality of individual flow channels arranged along the first direction. Each individual flow channel includes a first pressure chamber and a second pressure chamber arranged along the first direction, each of the first and second pressure chambers communicating with the common flow channel, a nozzle located away from the first pressure chamber and the second pressure chamber in a second direction orthogonal to the first direction, and a connection flow channel configured to connect the first pressure chamber, the second pressure chamber, and the nozzle with each other. The connection flow channel has a first end and a second end in the second direction, the first end of the connection flow channel in the second direction communicating with the first pressure chamber and the second pressure chamber, the second end of the connection flow channel in the second direction communicating with the nozzle. The connection flow channel extends along the second direction from the first end to the second end thereof in the second direction.

According to aspects of the present disclosure, further provided is a liquid discharge head that includes a common flow channel extending along a first direction, and a plurality of individual flow channels arranged along the first direction. Each individual flow channel includes a first pressure chamber and a second pressure chamber arranged along the first direction, each of the first and second pressure chambers communicating with the common flow channel, a nozzle located away from the first pressure chamber and the second pressure chamber in a second direction orthogonal to the first direction, and a connection flow channel configured to connect the first pressure chamber, the second pressure chamber, and the nozzle with each other. The connection flow channel has a first end and a second end in the second direction, the first end of the connection flow channel in the second direction communicating with the first pressure chamber and the second pressure chamber, the second end of the connection flow channel in the second direction communicating with the nozzle. The connection flow channel is further configured to communicate with nothing other than the first pressure chamber, the second pressure chamber, and the nozzle.

According to aspects of the present disclosure, further provided is a liquid discharge device that includes a common flow channel extending along a first direction, and a plurality of individual flow channels arranged along the first direction. Each individual flow channel includes a first pressure chamber and a second pressure chamber arranged along the first direction, each of the first and second pressure chambers communicating with the common flow channel, a nozzle located away from the first pressure chamber and the second pressure chamber in a second direction orthogonal to the first direction, and a connection flow channel configured to connect the first pressure chamber, the second pressure chamber, and the nozzle with each other. The connection flow channel has a first end and a second end in the second direction, the first end of the connection flow channel in the second direction communicating with the first pressure chamber and the second pressure chamber, the second end of the connection flow channel in the second direction communicating with the nozzle. The connection flow channel extends along the second direction from the first end to the second end thereof in the second direction. The liquid discharge device further includes a first actuator disposed to overlap with the first pressure chamber of each individual flow channel when viewed in the second direction, a second actuator disposed to overlap with the second pressure chamber of each individual flow channel when viewed in the second direction, and a controller configured to perform an in-phase driving process to provide in-phase drive signals to the first actuator and the second actuator, when causing the nozzle to discharge liquid therefrom.

According to aspects of the present disclosure, further provided is a liquid discharge device that includes a common flow channel extending along a first direction, and a plurality of individual flow channels arranged along the first direction. Each individual flow channel includes a first pressure chamber and a second pressure chamber arranged along the first direction, each of the first and second pressure chambers communicating with the common flow channel, a nozzle located away from the first pressure chamber and the second pressure chamber in a second direction orthogonal to the first direction, and a connection flow channel configured to connect the first pressure chamber, the second pressure chamber, and the nozzle with each other. The connection flow channel has a first end and a second end in the second direction, the first end of the connection flow channel in the second direction communicating with the first pressure chamber and the second pressure chamber, the second end of the connection flow channel in the second direction communicating with the nozzle. The connection flow channel is further configured to communicate with nothing other than the first pressure chamber, the second pressure chamber, and the nozzle. The liquid discharge device further includes a first actuator disposed to overlap with the first pressure chamber of each individual flow channel when viewed in the second direction, a second actuator disposed to overlap with the second pressure chamber of each individual flow channel when viewed in the second direction, and a controller configured to perform an in-phase driving process to provide in-phase drive signals to the first actuator and the second actuator, when causing the nozzle to discharge liquid therefrom.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

First Illustrative Embodiment

Figure 1:
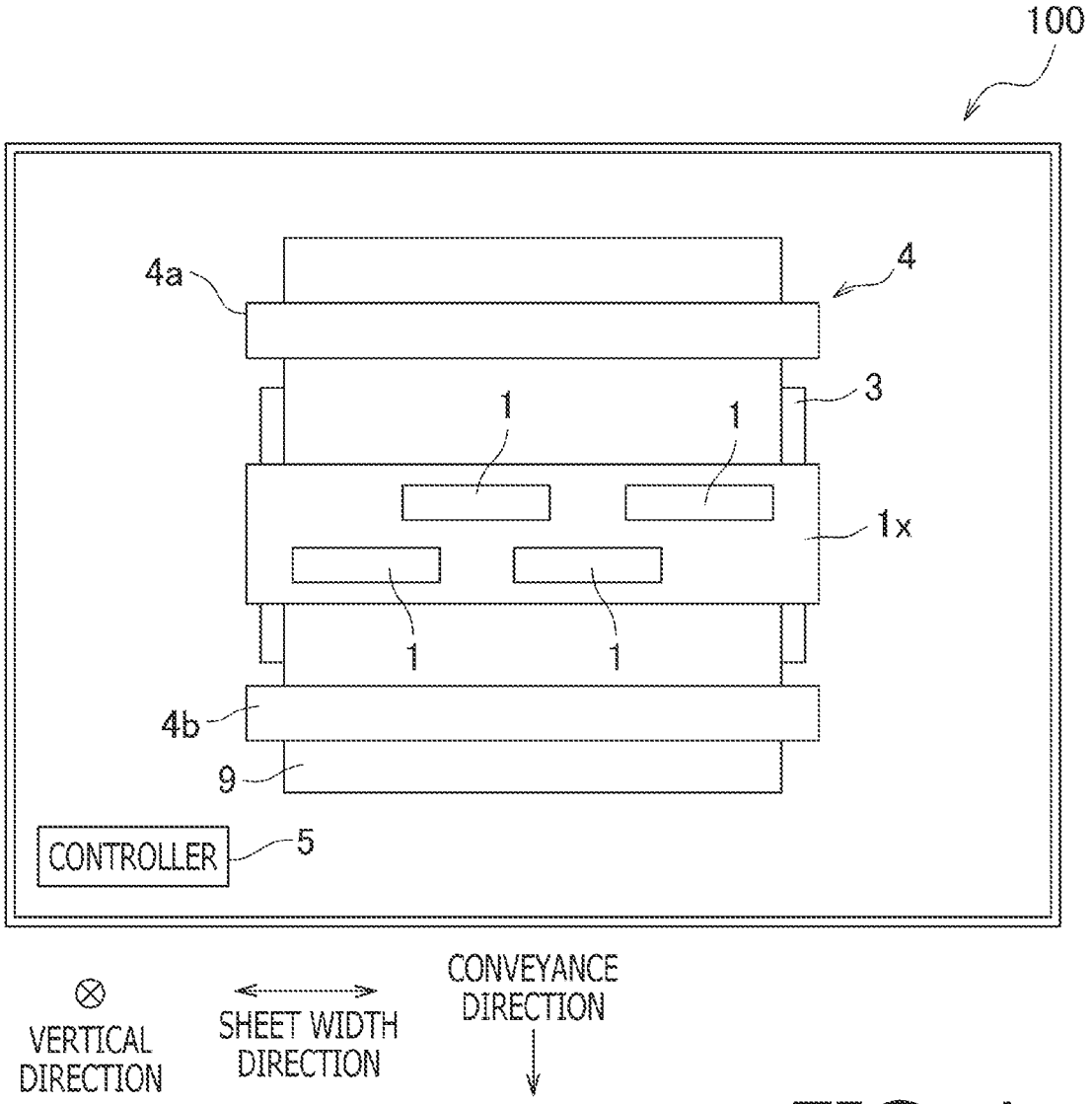
FIG. 1 is a plan view schematically showing a configuration of a printer having a plurality of heads, in a first illustrative embodiment according to one or more aspects of the present disclosure.

First, referring to FIG. 1, an explanation will be provided of an overall configuration of a printer 100 having heads 1 in a first illustrative embodiment according to aspects of the present disclosure.

The printer 100 includes a head unit 1*x*, a platen 3, a conveyor 4, and a controller 5. The head unit 1*x* includes four heads 1.

A sheet 9 is placed on the platen 3.

The conveyor 4 includes two roller pairs 4*a* and 4*b* that are disposed across the platen 3 in a conveyance direction. When a conveyance motor (not shown) is driven by the controller 5, the roller pairs 4*a* and 4*b* rotate with the sheet 9 pinched thereby, and the sheet 9 is conveyed in the conveyance direction.

The head unit 1*x* is formed long in its longitudinal direction along a sheet width direction (i.e., a direction orthogonal to both the conveyance direction and a vertical direction). The head unit 1*x* is of a line type to discharge ink from nozzles 22 (see FIGS. 2 to 5) onto the sheet 9 in a fixed position. Each of the four heads 1 is formed long in its longitudinal direction along the sheet width direction. The four heads 1 are arranged in a staggered manner along the sheet width direction.

The controller 5 has a ROM ("ROM" is an abbreviation for "Read Only Memory"), a RAM ("RAM" is an abbreviation for "Random Access Memory"), and an ASIC ("ASIC" is an abbreviation for "Application Specific Integrated Circuit"). The ASIC is configured to perform various processes such as a recording process in accordance with programs stored in the ROM. In the recording process, the controller 5 controls a driver IC 19 (see FIG. 3) of each head 1 and the conveyance motor (not shown) based on a recording command (including image data) input from an external device such as a PC, thereby recording an image on the sheet 9.

Subsequently, a configuration of each head 1 will be described with reference to FIGS. 2 to 6.

Figure 3:
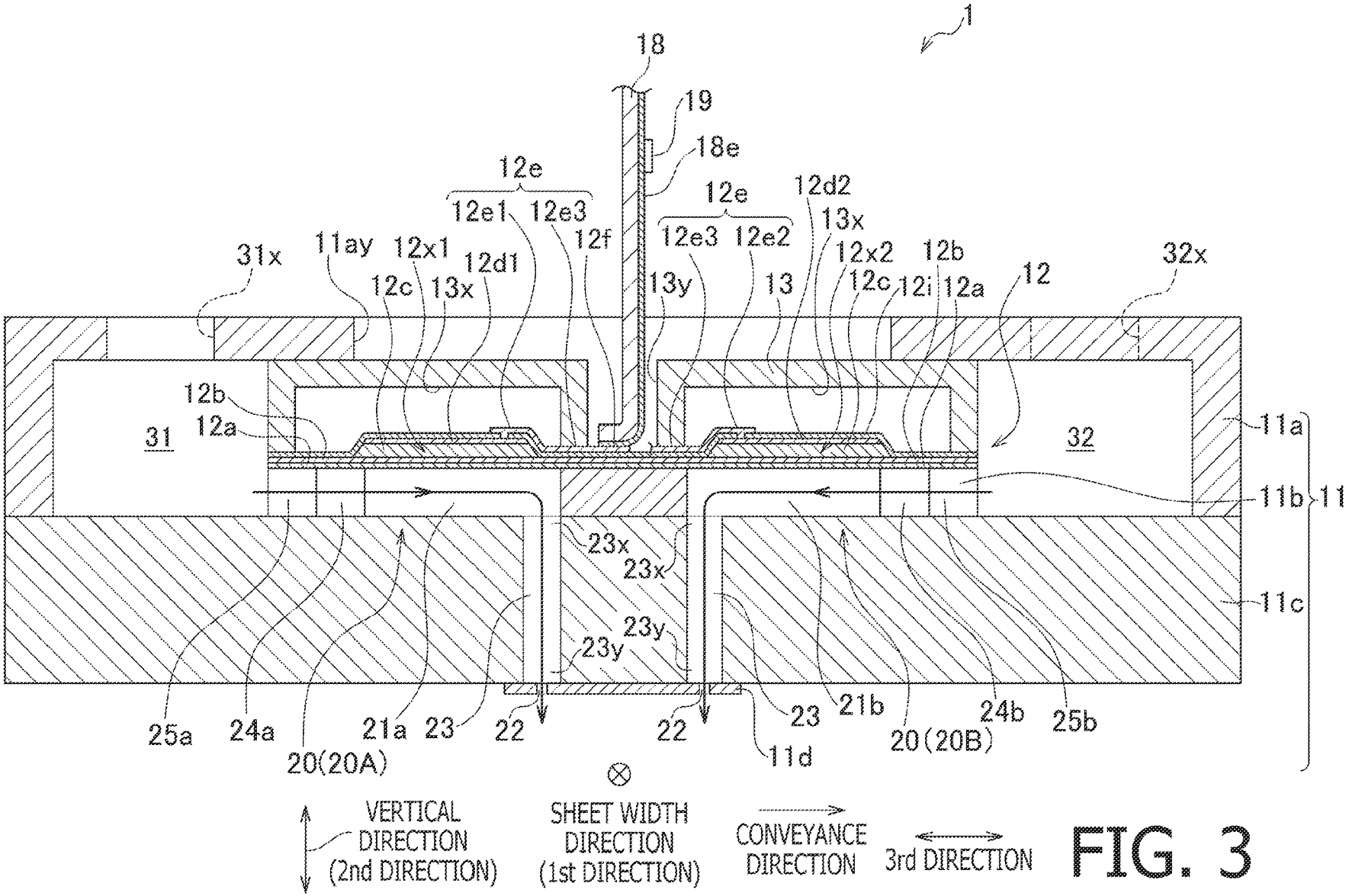
FIG. 3 is a cross-sectional view showing an internal configuration of each head along a line shown in FIG. 2, in the first illustrative embodiment according to one or more aspects of the present disclosure.

As shown in FIG. 3, each head 1 includes a flow channel substrate 11, an actuator substrate 12, a protective member 13, and a circuit board 18.

The flow channel substrate 11 includes four plates 11*a*-11*d* stacked vertically and bonded with each other. Of the four plates 11*a*-11*d*, the uppermost plate 11*a* is formed, for instance, by resin injection molding. Two common flow channels 31 and 32 are formed in the uppermost plate 11*a*. The other plates 11*b*-11*d* are made of, for instance, resin (e.g., LCP, "LCP" is an abbreviation for "Liquid Crystal Polymer") or metal (e.g., SUS, "SUS" is an abbreviation for "Steel Use Stainless"). A plurality of individual flow channels 20 are formed by the plates 11*b*-11*d*.

Figure 2:
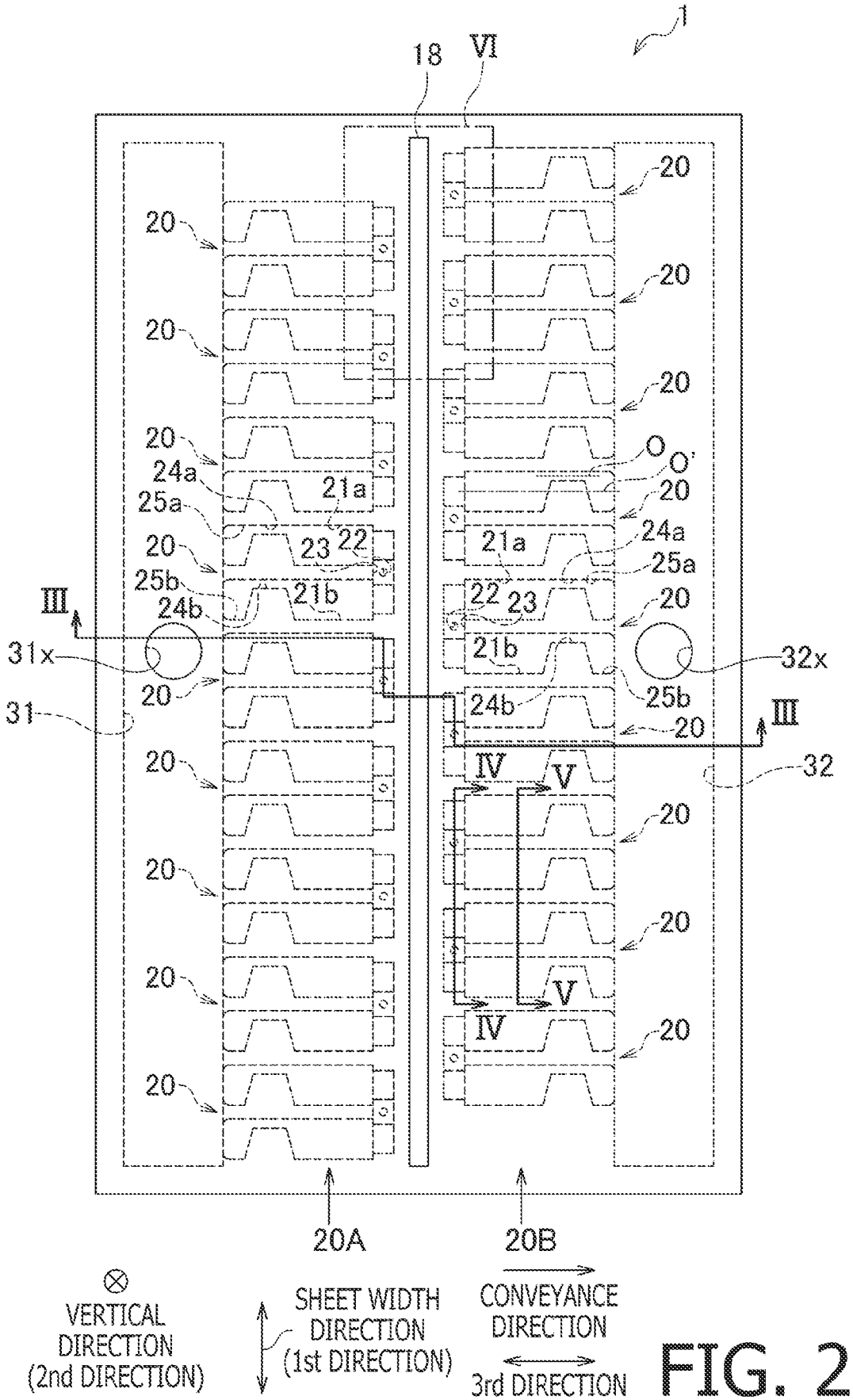
FIG. 2 is a plan view showing a configuration of each head of the printer in the first illustrative embodiment according to one or more aspects of the present disclosure.

As shown in FIG. 2, the plurality of individual flow channels 20 are separated into a first individual flow channel group 20A and a second individual flow channel group 20B. Each of the first and second individual flow channel groups 20A and 20B includes a plurality of individual flow channels 20 arranged along the sheet width direction. Hereinafter, the sheet width direction may be referred to as the "first direction." The first individual flow channel group 20A and the second individual flow channel group 20B are arranged along a third direction parallel to the conveyance direction. The third direction is orthogonal to the first direction. The plurality of individual flow channels 20 are arranged in a staggered manner along the first direction as a whole.

The common flow channels 31 and 32, each of which extends along the first direction, are arranged along the third direction. The plurality of individual flow channels 20 are disposed between the common flow channels 31 and 32 in the third direction. The common flow channels 31 and 32 communicate with a sub tank (not shown) via supply ports 31*x* and 32*x*, respectively. The sub tank communicates with a main tank that stores ink. The sub tank is configured to store ink supplied from the main tank. When a pump (not shown) is driven by the controller 5, the ink in the sub-tank flows into the common flow channels 31 and 32 via the supply ports 31*x* and 32*x*. The ink, which has flowed into the common flow channel 31, is supplied to each of the individual flow channels 20 of the first individual flow channel group 20A. The ink, which has flowed into the common flow channel 32, is supplied to each of the individual flow channels 20 of the second individual flow channel group 20B.

As shown in FIG. 2, each individual flow channel 20 includes two pressure chambers (i.e., the first pressure chamber 21*a* and the second pressure chamber 21*b*), one nozzle 22, one connection flow channel 23, two narrow flow channels 24*a* and 24*b*, and two wide flow channels 25*a* and 25*b*.

Each of the first and second pressure chambers 21*a* and 21*b* is formed substantially in a rectangle shape having a longitudinal direction along the third direction, in a plane orthogonal to the vertical direction. Hereinafter, the vertical direction may be referred to as a "second direction" that is orthogonal to the first direction and the third direction. Further, the first pressure chamber 21*a* and the second pressure chamber 21*b* are arranged along the first direction. An end of the first pressure chamber 21*a* in the third direction is connected with the connection flow channel 23. The other end of the first pressure chamber 21*a* in the third direction is connected with the narrow flow channel 24*a*. An end of the second pressure chamber 21*b* in the third direction is connected with the connection flow channel 23. The other end of the second pressure chamber 21*b* in the third direction is connected with the narrow flow channel 24*b*.

As shown in FIG. 2, the narrow flow channels 24*a* and 24*b* have a width less than a width (i.e., a length in the first direction) of the pressure chambers 21*a* and 21*b*. Each of the narrow flow channels 24*a* and 24*b* functions as an aperture. A centerline O of each narrow flow channel 24*a* in the first direction does not coincide, in the first direction, with a centerline O' of a corresponding first pressure chamber 21*a* in the first direction, and is located at one side (i.e., at an upper side, in FIG. 2) in the first direction relative to the centerline O'. Likewise, a centerline O of each narrow flow channel 24*b* in the first direction does not coincide, in the first direction, with a centerline O' of a corresponding second pressure chamber 21*b* in the first direction, and is located at the one side (i.e., at the upper side, in FIG. 2) in the first direction relative to the centerline O'. A relative position of each narrow flow channel 24*a* with respect to the corresponding first pressure chamber 21*a* in the first direction is substantially the same as a relative position of each narrow flow channel 24*b* with respect to the corresponding second pressure chamber 21*b* in the first direction.

As shown in FIG. 2, the wide flow channels 25*a* and 25*b* have substantially the same width as the width (i.e., the length in the first direction) of the pressure chambers 21*a* and 21*b*. A centerline of each wide flow channel 25*a* in the first direction coincides, in the first direction, with the centerline O' of a corresponding first pressure chamber 21*a* in the first direction. Likewise, a centerline of each wide flow channel 25*b* in the first direction coincides, in the first direction, with the centerline O' of a corresponding second pressure chamber 21*b* in the first direction.

Each first pressure chamber 21*a* is disposed side by side with the corresponding narrow flow channel 24*a* and the corresponding wide flow channel 25*a* in the third direction. In other words, each narrow flow channel 24*b* is disposed between the corresponding second pressure chamber 21*b* and the corresponding wide flow channel 25*b* in the third direction.

Each second pressure chamber 21*b* is disposed side by side with the corresponding narrow flow channel 24*b* and the corresponding wide flow channel 25*b* in the third direction. In other words, each narrow flow channel 24*b* is disposed between the corresponding second pressure chamber 21*b* and the corresponding wide flow channel 25*b* in the third direction.

In the third direction, the narrow flow channel 24*a* and the wide flow channel 25*a* are disposed between the common flow channel 31 and the first pressure chamber 21*a* of the first individual flow channel group 20A. In other words, via the narrow flow channel 24*a* and the wide flow channel 25*a*, the common flow channel 31 communicates with the first pressure chamber 21*a* of the first individual flow channel group 20A.

In the third direction, the narrow flow channel 24*b* and the wide flow channel 25*b* are disposed between the common flow channel 31 and the second pressure chamber 21*b* of the first individual flow channel group 20A. In other words, via the narrow flow channel 24*b* and the wide flow channel 25*b*, the common flow channel 31 communicates with the second pressure chamber 21*b* of the first individual flow channel group 20A.

In the third direction, the narrow flow channel 24*a* and the wide flow channel 25*a* are disposed between the common flow channel 32 and the first pressure chamber 21*a* of the second individual flow channel group 20B. In other words, via the narrow flow channel 24*a* and the wide flow channel 25*a*, the common flow channel 32 communicates with the first pressure chamber 21*a* of the second individual flow channel group 20B.

In the third direction, the narrow flow channel 24*b* and the wide flow channel 25*b* are disposed between the common flow channel 32 and the second pressure chamber 21*b* of the second individual flow channel group 20B. In other words, via the narrow flow channel 24*b* and the wide flow channel 25*b*, the common flow channel 32 communicates with the second pressure chamber 21*a* of the second individual flow channel group 20B.

As shown in FIG. 3, the pressure chambers 21*a* and 21*b*, the narrow flow channels 24*a* and 24*b*, and the wide flow channels 25*a* and 25*b* are formed by through holes formed in the plate 11*b*.

Figure 4:
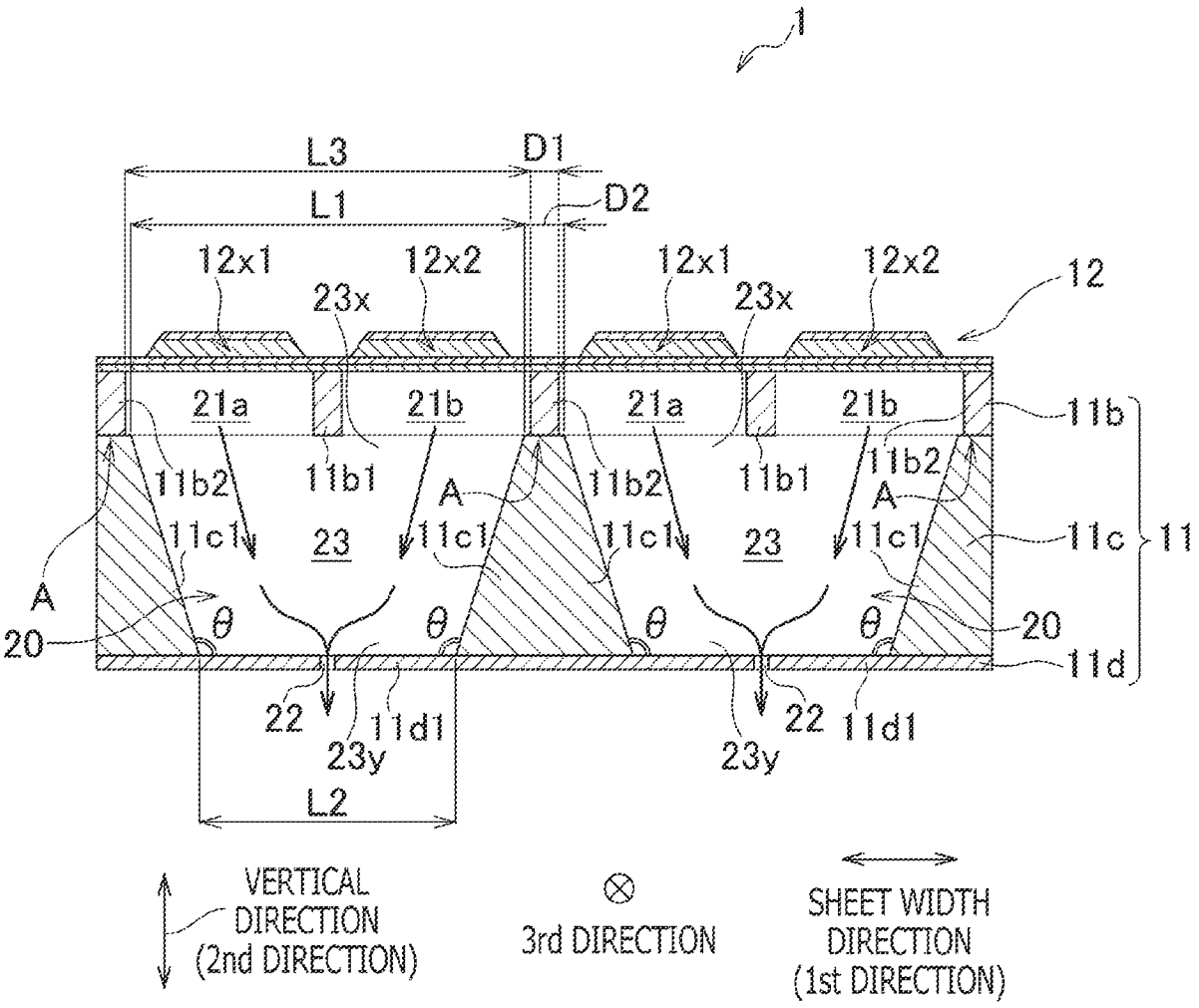
FIG. 4 is a cross-sectional view showing an internal configuration of each head along a line IV-IV shown in FIG. 2, in the first illustrative embodiment according to one or more aspects of the present disclosure.
Figure 5:
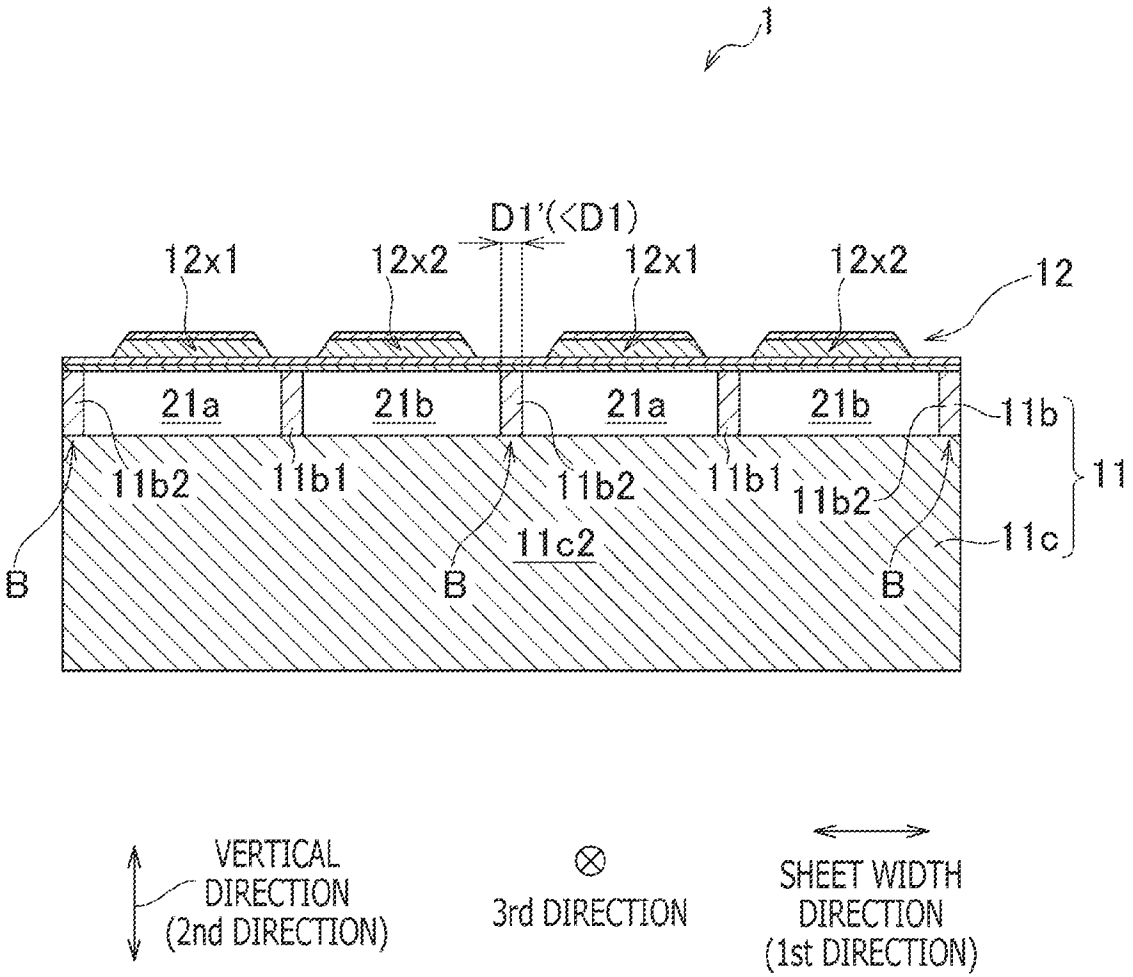
FIG. 5 is a cross-sectional view showing am internal configuration of each head along a line V-V shown in FIG. 2, in the first illustrative embodiment according to one or more aspects of the present disclosure.

In each individual flow channel 20, as shown in FIGS. 3 and 4, the connection flow channel 23 is formed by a through hole formed in the plate 11*c*, and connects the pressure chambers 21*a* and 21*b* and the nozzle 22 with each other. One end (i.e., an upper end) 23*x* of the connection flow channel 23 in the second direction is connected with the pressure chambers 21*a* and 21*b*. The other end (i.e., a lower end) 23*y* of the connection flow channel 23 in the second direction is connected with the nozzle 22. The connection flow channel 23 extends along the second direction from the one end 23*x* to the other end 23*y* thereof in the second direction.

The connection flow channel 23 communicates with the pressure chambers 21*a* and 21*b* and the nozzle 22 but does not communicate with anything other than the pressure chambers 21*a* and 21*b* and the nozzle 22. In other words, the connection flow channel 23 has, as connection interfaces with other elements, only a connection interface with the pressure chambers 21*a* and 21*b* at the one end 23*x* of the connection flow channel 23 in the second direction and another connection interface with the nozzle 22 at the other end 23*y* of the connection flow channel 23 in the second direction.

As shown in FIG. 4, the connection flow channel 23 has an inverted-trapezoid shape in a cross section orthogonal to the third direction (i.e., in a cross section along the first direction and the second direction). Namely, a length L1, in the first direction, of an upper base of the inverted-trapezoid shape is longer than a length L2, in the first direction, of a lower base of the inverted-trapezoid shape in the first direction.

Two interior angles (i.e., base angles) θ at both ends of the lower base are equal to each other, and are obtuse. In other words, in a cross section (see FIG. 4) orthogonal to the third direction (i.e., in a cross section along the first and second directions), the connection flow channel 23 is defined by two side walls 11*c*1 and a bottom wall 11*d*1. The two side walls 11*c*1 are formed to sandwich the connection flow channel 23 therebetween in the first direction. The bottom wall 11*d*1 is orthogonal to the second direction at the other end 23*y* of the connection flow channel 23 in the second direction. An angle θ formed between each side wall 11*c*1 and the bottom wall 11*d*1 is obtuse. The side walls 11*c*1 are formed by the plate 11*c*. The bottom wall 11*d*1 is formed by the plate 11*d*.

The first pressure chamber 21*a* is defined by a partition wall 11*b*1 and a side wall 11*b*2. The partition wall 11*b*1 is formed to separate the first pressure chamber 21*a* from the second pressure chamber 21*b* in the first direction. The side wall 11*b*2 is spaced apart from the partition wall 11*b*1 in the first direction. The partition wall 11*b*1 and the side wall 11*b*2 are configured to sandwich the first pressure chamber 21*a* therebetween in the first direction. The second pressure chamber 21*b* is defined by the partition wall 11*b*1 and a side wall 11*b*2. The side wall 11*b*2 is spaced apart from the partition wall 11*b*1 in the first direction. The partition wall 11*b*1 and the side wall 11*b*2 are configured to sandwich the second pressure chamber 21*b* therebetween in the first direction. The partition wall 11*b*1 and the side walls 11*b*2 are formed by the plate 11*b*.

Each side wall 11*b*2 has a bonding portion A (see FIG. 4) that is bonded with a corresponding side wall 11*c*1 of the connection flow channel 23. A thickness D1 of the bonding portion A in the first direction is greater than a thickness D1', in the first direction, of a portion B (see FIG. 5) other than the bonding portion A in the side wall 11*b*2. The portion B is bonded with side walls 11*c*2, which are formed by the plate 11*c* so as to sandwich the connection flow channel 23 therebetween in the third direction.

Since the thickness D1 is greater than the thickness D1', a width of an end (i.e., an end connected with the connection flow channel 23) of each of the pressure chambers 21*a* and 21*b* in the third direction is less than widths of any other portions of each of the pressure chambers 21*a* and 21*b*, as shown in FIG. 2.

As shown in FIG. 4, a thickness D2, in the first direction, of an upper end portion (i.e., a portion bonded with the bonding portion A) of each side wall 11*c*1 of the connection flow channel 23 is greater than the thickness D1 of the bonding portion A in the first direction. Further, the length L1, in the first direction, of the one end 23*x* of the connection flow channel 23 in the second direction (i.e., the length, in the first direction, of the upper base of the inverted-trapezoid shape) is slightly shorter than a length L3. The length L3 is a length in the first direction from a surface of the side wall 11*b*2 that is in contact with the first pressure chamber 21*a* to a surface of the side wall 11*b*2 that is in contact with the second pressure chamber 21*b*.

In each individual flow channel 20, the nozzle 22 is formed by a through hole formed in the plate 11*d*. The nozzle 22 is open in a lower surface of the flow channel substrate 11. The nozzle 22 is located just beneath the connection flow channel 23. The nozzle 22 is located downward away from the pressure chambers 21*a* and 21*b* in the second direction. The nozzle 22 is located substantially in a center between the first pressure chamber 21*a* and the second pressure chamber 21*b* in the first direction. The nozzle 22 overlaps with the partition wall 11*b*1 when viewed in the second direction.

As shown in FIG. 3, the actuator substrate 12 is fixedly attached to an upper surface of the plate 11*b*. The actuator substrate 12 includes, in order from the bottom, a diaphragm 12*a*, a common electrode 12*b*, a plurality of piezoelectric substances 12*c*, and a plurality of individual electrodes 12*d*1 and 12*d*2.

The diaphragm 12*a* and the common electrode 12*b* are disposed over the entire upper surface of the plate 11*b* and cover all the pressure chambers 21*a* and 21*b* formed in the plate 11*b*. On the other hand, for each of the pressure chambers 21*a* and 21*b*, a corresponding one of the piezoelectric substances 12*c* and a corresponding one of the individual electrodes 12*d*1 and 12*d*2 are provided to overlap with each pressure chamber 21*a*, 21*b* when viewed in the second direction.

Specifically, the individual electrode 12*d*1 is formed to overlap with the first pressure chamber 21*a* when viewed in the second direction. The individual electrode 12*d*2 is formed to overlap with the second pressure chamber 21*b* when viewed in the second direction.

The actuator substrate 12 further includes an insulating film 12*i* and a plurality of wires 12*e*.

The insulating film 12*i* includes silicon dioxide ($SiO_2$). The insulating film 12*i* covers a portion of an upper surface of the common electrode 12*b* where the piezoelectric substances 12*c* are not provided, side surfaces of the piezoelectric substances 12*c*, and upper surfaces of the individual electrodes 12*d*1 and 12*d*2. A through hole is formed in a portion of the insulating film 12*i* that overlaps with each of the individual electrodes 12*d*1 and 12*d*2 when viewed in the second direction.

Figure 6:
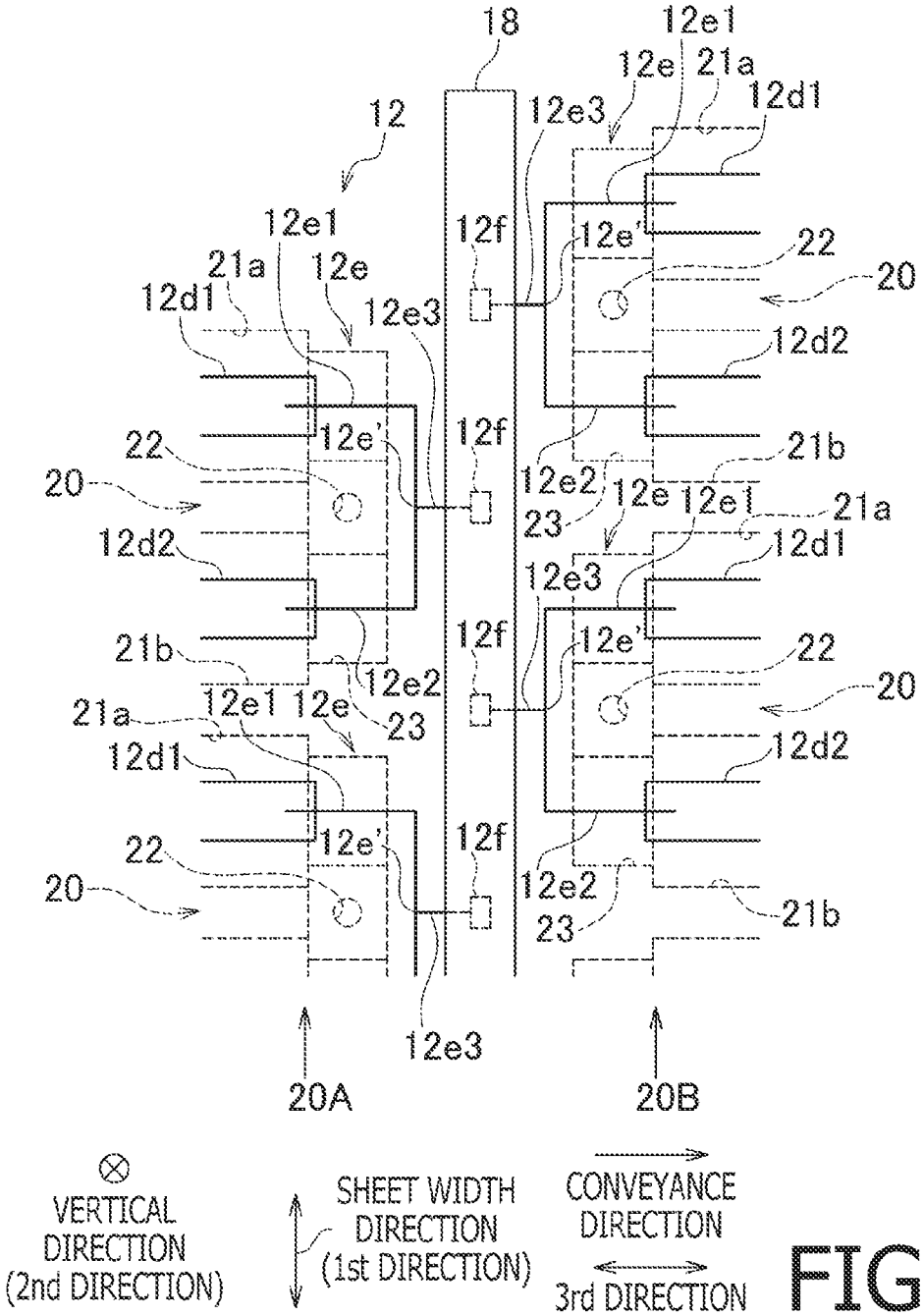
FIG. 6 is an enlarged view of an area VI shown in FIG. 2, in the first illustrative embodiment according to one or more aspects of the present disclosure.

The plurality of wires 12*e* are formed on the insulating film 12*i*. As shown in FIG. 6, a corresponding one of the wires 12*e* is provided for each individual flow channel 20. Each wire 12*e* has an L-shaped first portion 12*e*1 connected with the individual electrode 12*d*1, an L-shaped second portion 12*e*2 connected with the individual electrode 12*d*2 and the first portion 12*e*1, and a third portion 12*e*3 extending in the third direction from a connecting portion 12*e*' between the first portion 12*e*1 and the second portion 12*e*2. As shown in FIG. 3, the first portion 12*e*1 is electrically connected with the individual electrode 12*d*1, since a tip of the first portion 12*e*1 is inserted into the corresponding through hole formed in the insulating film 12*i*. Likewise, the second portion 12*e*2 is electrically connected with the individual electrode 12*d*2, since a tip of the second portion 12*e*2 is inserted into the corresponding through hole formed in the insulating film 12*i*. The third portion 12*e*3 extends up to a center portion of the actuator substrate 12 in the third direction. A contact 12*f* is formed at a tip portion of the third portion 12*e*3 extending in the third direction (see FIGS. 3 and 6). The contact 12*f* is configured to connect the individual electrodes 12*d*1 and 12*d*2 with each other.

The circuit board 18 includes a COF ("COF" is an abbreviation for "Chip On Film"). One end of the circuit board 18 is fixedly attached to a central area of an upper surface of the actuator substrate 12 in the third direction. The one end of the circuit board 18 extends in the first direction on the upper surface of the actuator substrate 12 (see FIGS. 2 and 6), and has a plurality of individual wires 18*e* (see FIG. 3) and a common wire (not shown). Each of the individual wires 18*e* is electrically connected with a corresponding one of the contacts 12*f*. A corresponding one of the individual wires 18*e* is provided for each individual flow channel 20. The common wire is electrically connected with the common electrode 12*b* through a through hole formed in the insulating film 12*i*.

As shown in FIG. 3, the circuit board 18 extends upward from the upper surface of the actuator substrate 12. The other end of the circuit board 18 is connected with the controller 5 (see FIG. 1). A driver IC 19 is mounted between the one end and the other end of the circuit board 18.

The driver IC 19 is electrically connected with the individual electrodes 12*d*1 and 12*d*2 via the individual wire 18*e* and electrically connected with the common electrode 12*b* via the common wire. The driver IC 19 maintains an electric potential of the common electrode 12*b* to be the ground potential. Meanwhile, the driver IC generates a drive signal based on a control signal from the controller 5 and provides the generated drive signal to the individual electrodes 12*d*1 and 12*d*2, thereby changing electric potentials of the individual electrodes 12*d*1 and 12*d*2 between a particular drive potential and the ground potential. At this time, the diaphragm 12*a* and a portion (i.e., an actuator 12*x*1) sandwiched between the individual electrode 12*d*1 and the pressure chamber 21*a* in the corresponding piezoelectric substance 12*c* are deformed in such a manner as to become convex toward the pressure chamber 21*a*. Such deformation changes a volume of the pressure chamber 21*a*, applies a pressure to the ink in the pressure chamber 21*a*, and causes the corresponding nozzle 22 to discharge the ink therefrom. Likewise, at this time, the diaphragm 12*a* and a portion (i.e., an actuator 12*x*2) sandwiched between the individual electrode 12*d*2 and the pressure chamber 21*b* in the corresponding piezoelectric substance 12*c* are deformed in such a manner as to become convex toward the pressure chamber 21*b*. Such deformation changes a volume of the pressure chamber 21*b*, applies a pressure to the ink in the pressure chamber 21*b*, and causes the corresponding nozzle 22 to discharge the ink therefrom.

In the first illustrative embodiment, the two individual electrodes 12*d*1 and 12*d*2 provided for each individual flow channel 20 are electrically connected with each other. Therefore, the electric potentials of the two individual electrodes 12*d*1 and 12*d*2 for each individual flow channel 20 change in substantially the same manner. In other words, to discharge the ink from the nozzle 22 of each individual flow channel 20, the controller 5 performs an in-phase driving process to provide in-phase drive signals to the actuator 12*x*1 and the actuator 12*x*2. Hereinafter, the actuator 12*x*1, disposed to overlap with the first pressure chamber 21*a* when viewed in the second direction, may be referred to as the "first actuator." Further, the actuator 12*x*2, disposed to overlap with the second pressure chamber 21*b* when viewed in the second direction, may be referred to as the "second actuator."

To discharge ink from the nozzles 22, ink is supplied from the common flow channels 31 and 32 to each individual flow channel 20. The ink supplied to each individual flow channel 20 flows into the pressure chambers 21*a* and 21*b* through the wide flow channels 25*a* and 25*b* and the narrow flow channels 24*a* and 24*b*. The ink moves in the third direction in the pressure chambers 21*a* and 21*b*, further moves downward in the second direction through the connection flow channel 23, and is discharged from the nozzle 22.

As shown in FIG. 3, the protective member 13 is bonded with the upper surface of the actuator substrate 12. The protective member 13 is formed with two recesses 13*x* and a through hole 13*y*.

Each of the two recesses 13*x* extends in the first direction. One of the two recesses 13*x* accommodates a plurality of actuators 12*x*1 and 12*x*2 corresponding to the first individual flow channel group 20A. The other of the two recesses 13*x* accommodates a plurality of actuators 12*x*1 and 12*x*2 corresponding to the second individual flow channel group 20B.

The through hole 13*y* extends in the first direction in a center of the protective member 13 in the third direction. The plate 11*a* has a portion disposed on an upper surface of the protective member 13 and has a through hole 11*ay* that overlaps with the through hole 13*y* when viewed in the second direction. The circuit board 18 extends upward via the through hole 13*y* and the through hole 11*ay*.

It is noted that the protective member 13 is not shown in FIGS. 2 and 4 to 6.

As described above, in the first illustrative embodiment, each individual flow channel 20 includes the first pressure chamber 21*a*, the second pressure chamber 21*b*, and the connection flow channel 23. The one end 23*x* of the connection flow channel 23 in the second direction communicates with the first pressure chamber 21*a* and the second pressure chamber 21*b*. The other end 23*y* of the connection flow channel 23 in the second direction communicates with the nozzle 22 (see FIG. 4). Thus, in each individual flow channel 20, a discharge pressure is applied by the two pressure chambers 21*a* and 21*b*. Thereby, it is possible to achieve a higher discharge pressure. Further, an AL ("AL" is abbreviation for "Acoustic Length" representing a one-way propagation time of a pressure wave in each individual flow channel 20) is substantially the same as when each individual flow channel 20 includes a single pressure chamber. Therefore, it is possible to discharge ink at a high frequency. Accordingly, it is possible to stably discharge some types of ink (e.g., high-viscosity ink, special glossy ink, etc.) requiring a high discharge pressure at a high frequency. It is noted that examples of the "high-viscosity ink" may include, but are not limited to, ink having a viscosity of about 10 to 20 cps and containing a resin component. Further, examples of the "special glossy ink" may include, but are not limited to, silver metallic ink containing particles (such as flat particles) of large diameters. Furthermore, the "high frequency" may be about 50 kHz.

Figure 11:
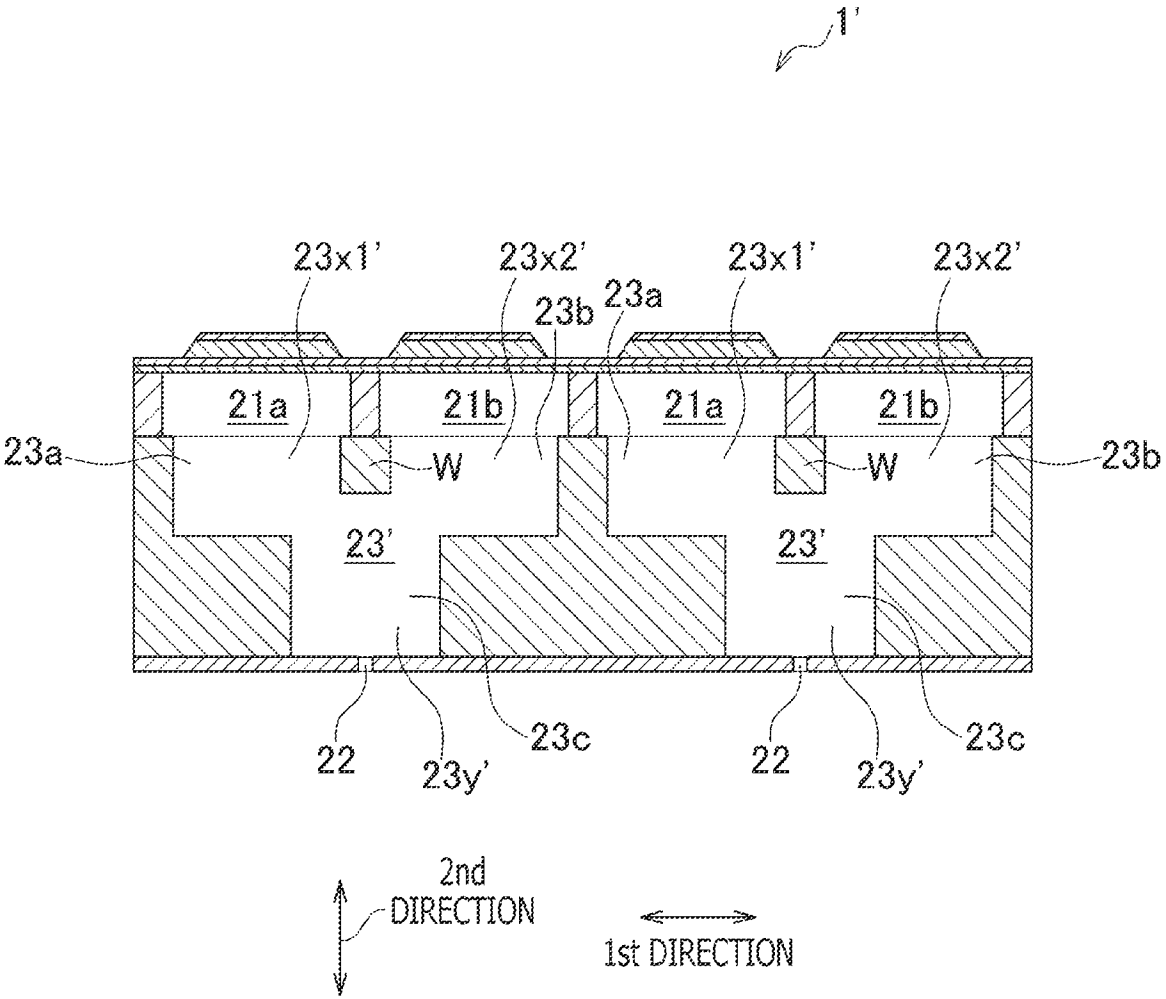
FIG. 11 is a cross-sectional view showing an internal configuration of each head along a line corresponding to the line IV-IV shown in FIG. 2, in a modification according to one or more aspects of the present disclosure.

Furthermore, in the first illustrative embodiment, the connection flow channel 23 extends along the second direction from the one end 23*x* to the other end 23*y* of the connection flow channel 23 in the second direction. Suppose for instance that the connection flow channel 23 is configured to bifurcate or integrate between the one end 23*x* and the other end 23*y* thereof in the second direction (see FIG. 11). Such configuration results in a bent portion formed at the bifurcation point or the integration point. Thereby, stagnation of the ink and/or retention of air bubbles is likely to be caused at the bent portion. In addition, the presence of the bent portion increases a flow resistance of the entire connection flow channel 23. In contrast, in the first illustrative embodiment, the connection flow channel 23 extends along the second direction from the one end 23*x* to the other end 23*y* of the connection flow channel 23 in the second direction, as described above. Therefore, it is possible to avoid the above problems such as the stagnation of the ink, the retention of air bubbles, and the increase in the flow resistance of the entire connection flow channel 23.

Further, in the first illustrative embodiment, the connection flow channel 23 communicates with nothing other than the first pressure chamber 21*a*, the second pressure chamber 21*b*, and the nozzle 22. Suppose for instance that the connection flow channel 23 communicates with another flow channel (e.g., a flow channel other than the common flow channels 31 and 32 that communicates the plurality of individual flow channels 20 with the sub-tank) other than the first pressure chamber 21*a*, the second pressure chamber 21*b*, and the nozzle 22. In such a case, since a discharge pressure from the pressure chambers 21*a* and 21*b* escapes into the said another flow channel, a discharge pressure applied to the nozzle 22 decreases. In contrast, in the first illustrative embodiment, the connection flow channel 23 communicates with nothing other than the first pressure chamber 21*a*, the second pressure chamber 21*b*, and the nozzle 22, as described above. Therefore, the discharge pressure from the pressure chambers 21*a* and 21*b* is efficiently applied to the nozzle 22, without escaping anywhere.

As shown in FIG. 6, the actuator substrate 12 has the contacts 12*f* each of which connects the corresponding individual electrodes 12*d*1 and 12*d*2 with each other. Each of the individual wires 18*e* (see FIG. 3) of the circuit board 18 is connected with a corresponding one of the contacts 12*f*. In this case, the number of the individual wires 18*e* is reduced by half in comparison with a case where an individual wires 18*e* is provided for each of the individual electrodes 12*d*1 and 12*d*2 (i.e., a case where two individual wires 18*e* are provided for each individual flow channel 20). Namely, in this case, since only a single individual wire 18*e* needs to be provided for each individual flow channel 20, the circuit board 18 is easier to manufacture. Further, in the first illustrative embodiment, the number of electrical connections between the wires 12*e* of the actuator substrate 12 and the individual wires 18*e* of the circuit board 18 is also reduced by half. Thus, it is possible to suppress connection failures.

In each individual flow channel 20, the nozzle 22 is located substantially in the center between the first pressure chamber 21*a* and the second pressure chamber 21*b* in the first direction (see FIG. 4). When the actuator 12*x*1 provided for the first pressure chamber 21*a* and the actuator 12*x*2 provided for the second pressure chamber 21*b* are driven in phase, the ink pressurized in the first pressure chamber 21*a* and the ink pressurized in the second pressure chamber 21*b* meet substantially in the center between the pressure chambers 21*a* and 21*b* in the first direction. Thus, the nozzle 22, which is located substantially in the center between the pressure chambers 21*a* and 21*b* in the first direction, is enabled to stably discharge ink therefrom.

Suppose for instance that the relative position of the narrow flow channel 24*a* with respect to the first pressure chamber 21*a* in the first direction is different from the relative position of the narrow flow channel 24*b* with respect to the second pressure chamber 21*b* in the first direction. In other words, suppose for instance that the centerline O of the narrow flow channel 24*a* is located at one side (e.g., the upper side in FIG. 2) in the first direction relative to the centerline O' of the corresponding pressure chamber 21*a* and that the centerline O of the narrow channel 24*b* is located at the other side (e.g., the lower side in FIG. 2) in the first direction relative to the centerline O' of the corresponding pressure chamber 21*a*). In such a case, respective manufacturing conditions for the narrow flow channels 24*a* and 24*b* are different from each other, it might result in production variation. In contrast, in the first illustrative embodiment, the relative position of the narrow flow channel 24*a* with respect to the first pressure chamber 21*a* in the first direction is substantially the same as the relative position of the narrow flow channel 24*b* with respect to the second pressure chamber 21*b* in the first direction (see FIG. 2). Thereby, since the respective manufacturing conditions for the narrow flow channels 24*a* and 24*b* are substantially the same as each other, it is possible to suppress the production variation.

Suppose for instance that the angle θ (see FIG. 4) formed between each side wall 11*c*1 and the bottom wall 11*d*1 in the connection flow channel 23 is an acute angle or a right angle. In such a case, stagnation of the ink and/or retention of air bubbles is likely to occur at the portions of the acute angle and the right angle. In contrast, in the first illustrative embodiment, since the angle θ is obtuse, the ink flows smoothly toward the nozzle 22. Thus, the stagnation of the ink and/or the retention of air bubbles is less likely to occur.

Each of the side walls 11*b*2 of the pressure chambers 21*a* and 21*b* has the bonding portion A (see FIG. 4) that is bonded with the corresponding side wall 11*c*1 of the connection flow channel 23. The thickness D1 of the bonding portion A in the first direction is greater than the thickness D1', in the first direction, of the portion B (see FIG. 5) other than the bonding portion A in the sidewall 11*b*2. In this case, it is possible to secure a sufficient bonding area between the side wall 11*b*2 and the side wall 11*c*1 and achieve a firm bond therebetween.

The thickness D2, in the first direction, of the upper end portion (i.e., the portion bonded with the bonding portion A as shown in FIG. 4) of each side wall 11*c*1 of the connection flow channel 23 is greater than the thickness D1 of the bonding portion A in the first direction. Further, the length L1, in the first direction, of the one end 23*x* of the connection flow channel 23 in the second direction (i.e., the length, in the first direction, of the upper base of the inverted-trapezoid shape) is shorter than the length L3 (see FIG. 4). It is noted that, as described above, the length L3 is a length in the first direction from the surface of the side wall 11*b*2 that is in contact with the first pressure chamber 21*a* to the surface of the side wall 11*b*2 that is in contact with the second pressure chamber 21*b*. In this case, even though there is a positional displacement caused between the member (i.e., the plate 11*b*) forming the side walls 11*b*2 and the member (i.e., the plate 11*c*) forming the side walls 11*c*1, each side wall 11*b*2 is allowed to be bonded with the corresponding side wall 11*c*1. Thus, it is possible to suppress bonding failures.

Second Illustrative Embodiment

Subsequently, a second illustrative embodiment according to aspects of the present disclosure will be described with reference to FIG. 7.

In the aforementioned first illustrative embodiment (see FIG. 6), each of the wires 12*e* of the actuator substrate 12 electrically connects the corresponding individual electrodes 12*d*1 and 12*d*2 with each other. On the other hand, in the second illustrative embodiment (see FIGS. 7A and 7B), each individual wire 218*e* of a circuit board 218 connects corresponding individual electrodes 12*d*1 and 12*d*2 with each other.

Further, in the aforementioned first illustrative embodiment (see FIG. 6), the plurality of individual flow channels 20 form the two individual flow channel groups, i.e., the first individual flow channel group 20A and the second individual flow channel group 20B that are arranged side by side along the third direction. On the other hand, in the second illustrative embodiment (see FIGS. 7A and 7B), a plurality of individual flow channels 20 form a single individual flow channel group 20A.

Figure 7A:
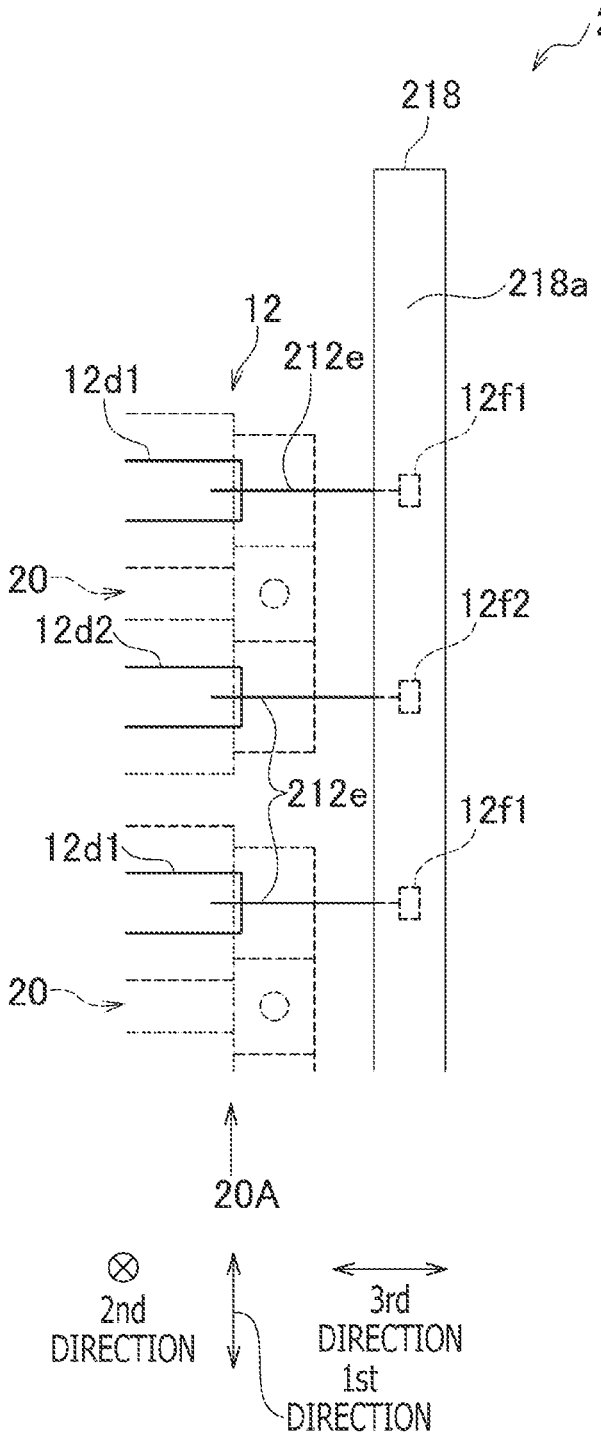
FIG. 7A is an enlarged view of an area corresponding to the area VI shown in FIG. 2, which partially shows a configuration of each head included in a printer, in a second illustrative embodiment according to one or more aspects of the present disclosure.

Specifically, as shown in FIG. 7A, in a head 201 of the second illustrative embodiment, one of a plurality of wires 212*e* of the actuator substrate 12 is provided not for each of the individual flow channels 20 but for each of the individual electrodes 12*d*1 and 12*d*2. Each wire 212*e* extends in the third direction from a corresponding one of the individual electrodes 12*d*1 and 12*d*2, and has a corresponding one of contacts 12*f*1 and 12*f*2 at a tip portion thereof. More specifically, each contact 12*f*1 is formed at the tip portion of the corresponding wire 212*e* connected with the corresponding individual electrode 12*d*1. Further, each contact 12*f*2 is formed at the tip portion of the corresponding wire 212*e* connected with the corresponding individual electrode 12*d*2. The contacts 12*f*1 and 12*f*2 are arranged alternately along the first direction.

Figure 7B:
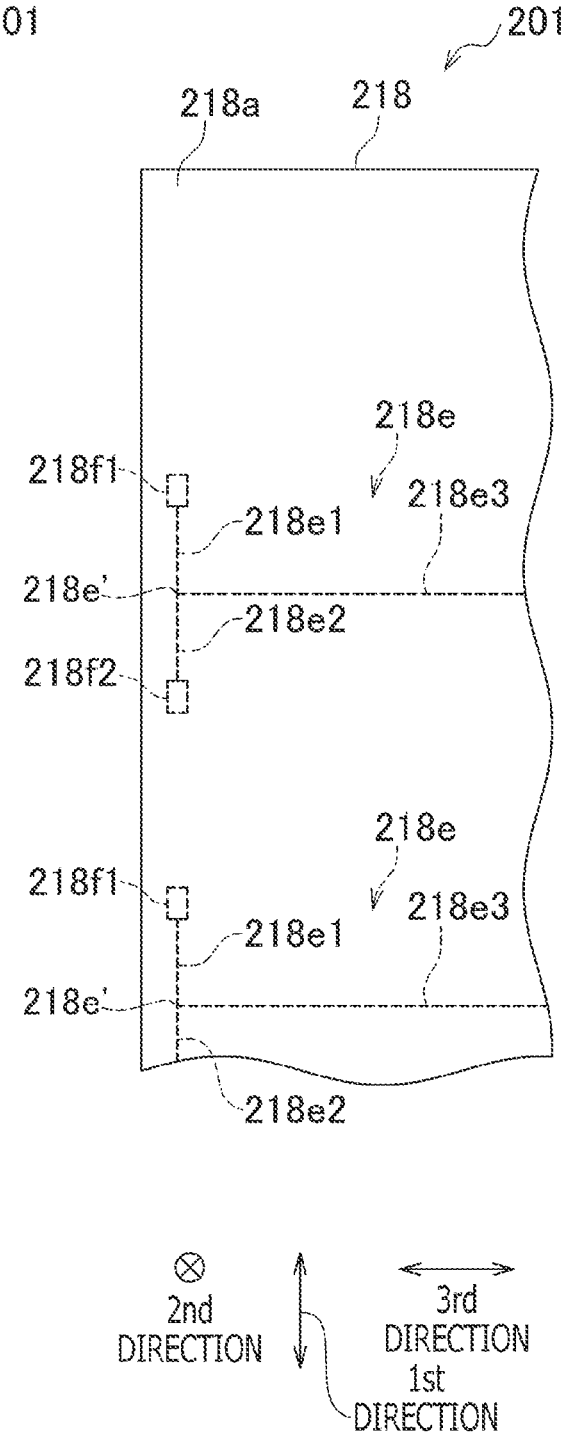
FIG. 7B shows a wiring pattern on a circuit board of each head, in the second illustrative embodiment according to one or more aspects of the present disclosure.

The circuit board 218 has contacts 218*f*1 and 218*f*2 at an end 218*a* thereof that is fixedly attached to the actuator substrate 12, as shown in FIG. 7B. The contacts 218*f*1 and 218*f*2 are arranged alternately along the first direction, substantially in the same manner as the contacts 12*f*1 and 12*f*2 of the actuator substrate 12 shown in FIG. 7A. Each contact 218*f*1 overlaps with the corresponding contact 12*f*1 when viewed in the second direction, and is in contact with the corresponding contact 12*f*1. Each contact 218*f*2 overlaps with the corresponding contact 12*f*2 when viewed in the second direction, and is in contact with the corresponding contact 12*f*2.

For each of the individual flow channels 20, a corresponding one of the individual wires 218*e* of the circuit board 218 is provided. As shown in FIG. 7B, each of the individual wires 218*e* has a first portion 218*e*1, a second portion 218*e*2, and a third portion 218*e*3. The first portion 218*e*1 extends in the first direction from the contact 218*f*1. The second portion 218*e*2 extends in the first direction from the contact 218*f*2 and is connected with the first portion 218*e*1. The third portion 218*e*3 extends in the third direction from a connecting portion 218*e*' between the first portion 218*e*1 and the second portion 218*e*2. The first portion 218*e*1 is connected with the individual electrode 12*d*1. The second portion 218*e*2 is connected with the individual electrode 12*d*2.

As described above, according to the second illustrative embodiment, the number of the individual wires 218*e* is reduced by half in comparison with a case where an individual wire 218*e* is provided for each of the individual electrodes 12*d*1 and 12*d*2 (i.e., a case where two individual wires 218*e* are provided for each of the individual flow channels 20). Namely, in the second illustrative embodiment, since only a single individual wire 218*e* needs to be provided for each of the individual flow channels 20, the circuit board 218 is easy to manufacture.

Third Illustrative Embodiment

Subsequently, a third illustrative embodiment according to aspects of the present disclosure will be described with reference to FIGS. 8 and 9.

In the aforementioned first illustrative embodiment (see FIG. 6), the individual electrodes 12*d*1 and 12*d*2 for each individual flow channel 20 are electrically connected with each other via the wire 12*e* of the actuator substrate 12. Further, in the aforementioned second illustrative embodiment (see FIGS. 7A and 7B), the individual electrodes 12*d*1 and 12*d*2 for each individual flow channel 20 are electrically connected with each other via the individual wire 218*e* of the circuit board 218. On the other hand, in the third illustrative embodiment, the individual electrodes 12*d*1 and 12*d*2 for each individual flow channel 20 are not electrically connected with each other.

Specifically, in a head 301 of the third illustrative embodiment, an actuator substrate 12 is configured in substantially the same manner as in the second illustrative embodiment (see FIG. 7A). Specifically, one of a plurality of wires 212*e* of the actuator substrate 12 is provided not for each individual flow channel 20 but for each of the individual electrodes 12*d*1 and 12*d*2.

Figure 8:
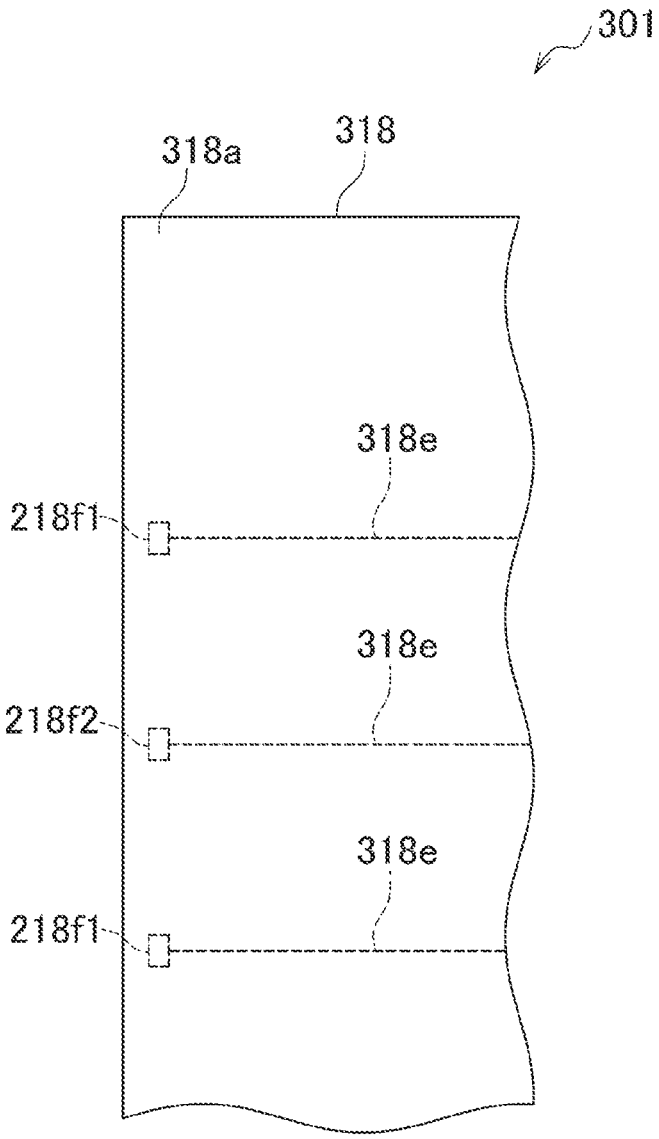
FIG. 8 shows a wiring pattern on a circuit board of each head included in a printer, in a third illustrative embodiment according to one or more aspects of the present disclosure.

As shown in FIG. 8, a circuit board 318 has contacts 218*f*1 and 218*f*2 at one end 318*a* of the circuit board 318, in a similar manner to the circuit board 218 in the aforementioned second illustrative embodiment (see FIG. 7B). One of a plurality of individual wires 318*e* of the circuit board 318 is provided not for each of the individual flow channels 20 but for each of the contacts 218*f*1 and 218*f*2 (i.e., for each of the individual electrodes 12*d*1 and 12*d*2). Each of the individual wires 318*e* extends from a corresponding one of the contacts 218*f*1 and 218*f*2 and is connected with the controller 5 (see FIG. 1) at the other end of the circuit board 318.

In the third illustrative embodiment, the aforementioned configuration enables the controller 5 to individually control each of the individual electrodes 12*d*1 and 12*d*2. Specifically, to discharge the ink from the nozzle 22 (see FIG. 4) of each individual flow channel 20, the controller 5 selectively performs one of an in-phase driving process and an individual driving process. In the in-phase driving process, the controller 5 provides in-phase drive signals to the actuator 12*x*1 (hereinafter, which may be referred to as the "first actuator") that overlaps with the first pressure chamber 21*a* when viewed in the second direction and the actuator 12*x*2 (hereinafter, which may be referred to as the "second actuator") that overlaps with the second pressure chamber 21*b* when viewed in the second direction. In the individual driving process, the controller 5 provides respective different drive signals to the first actuator and the second actuator.

For instance, in the individual driving process, the controller 5 may provide the first actuator with a discharge drive signal (see FIG. 9A) to cause the first actuator to discharge the ink from the nozzle 22, and may provide the second actuator with a cancellation drive signal (see FIG. 9B) to cancel residual vibrations (e.g., vibrations remaining in a corresponding one of the pressure chambers 21*a* and 21*b*).

In another instance, in the individual driving process, the controller 5 may provide the first actuator with the discharge drive signal (see FIG. 9A) to cause the first actuator to discharge the ink from the nozzle 22, and may provide the second actuator with a non-discharge drive signal (see FIG. 9C) to vibrate a meniscus of ink formed in the nozzle 22 without discharging the ink from the nozzle 22.

Figure 9A:
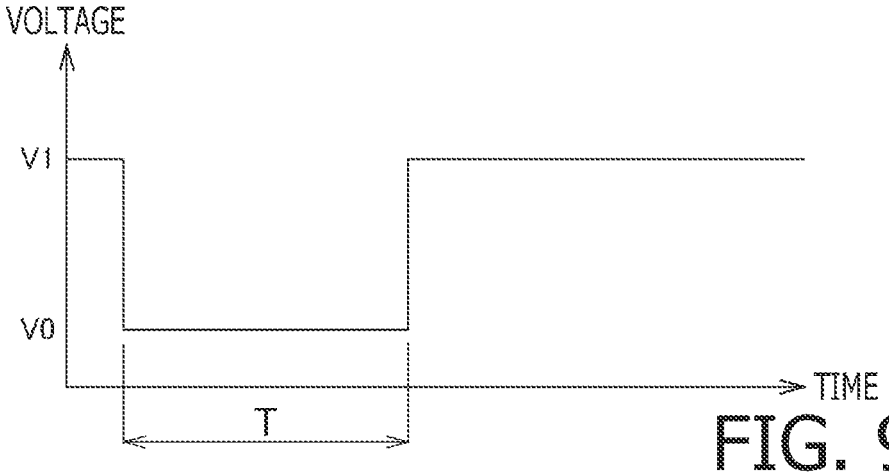
FIG. 9A shows an example of a discharge drive signal for an actuator included in a head, in the third illustrative embodiment according to one or more aspects of the present disclosure.

FIG. 9A shows an example of the discharge drive signal, which has one pulse in one recording cycle and causes the nozzle 22 to discharge a small-sized ink droplet therefrom. A pulse width T of the discharge drive signal is equal to the AL ("AL" is an abbreviation for "Acoustic Length" representing a one-way propagation time of a pressure wave in each individual flow channel 20). It is noted that the discharge drive signal may have two pulses in one recording cycle when a medium-sized ink droplet is discharged from the nozzle 22, and may have three pulses in one recording cycle when a large-sized ink droplet is discharged from the nozzle 22. Suppose for instance that the discharge drive signal shown in FIG. 9A is supplied to the first actuator for an individual flow channel 20. In this case, in an initial state, the individual electrode 12*d*1 is provided with a particular potential V1, and the actuator 12*x*1 is deformed convexly toward the first pressure chamber 21*a*. Then, at a timing when the electric potential of the individual electrode 12*d*1 becomes the ground potential V0, the actuator 12*x*1 is flattened, and the volume of the first pressure chamber 21*a* is made greater than the initial state. At this time, the ink is sucked from a corresponding one of the common flow channels 31 and 32 into the individual flow channel 20. Afterward, at a particular timing, the potential V1 is again applied to the individual electrode 12*d*1, and the actuator 12*x*1 is deformed convexly toward the first pressure chamber 21*a*. Thus, a pressure of the ink rises in response to the volume of the first pressure chamber 21*a* being reduced due to the deformation of the actuator 12*x*1, and the ink is discharged from the nozzle 22. It is noted that substantially the same applies to a case where the discharge drive signal shown in FIG. 9A is supplied to the second actuator.

Figure 9B:
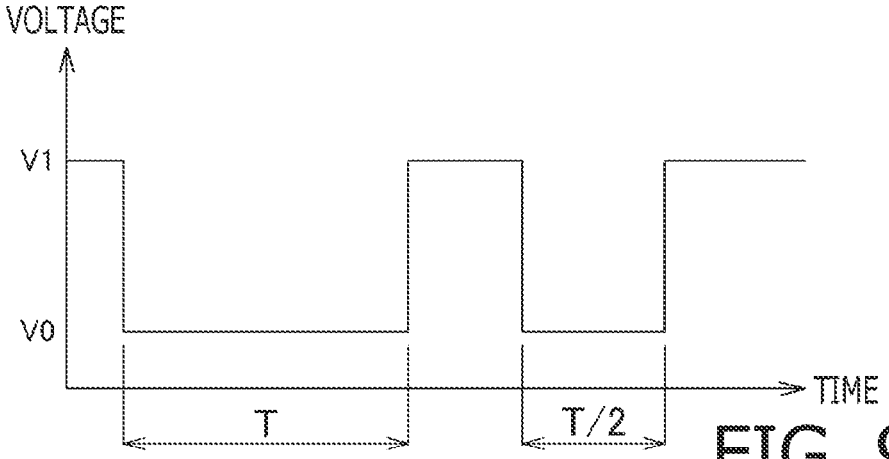
FIG. 9B shows an example of a cancellation drive signal for an actuator included in the head, in the third illustrative embodiment according to one or more aspects of the present disclosure.

FIG. 9B shows an example of the cancellation drive signal, which has a main pulse and a cancellation pulse in one recording cycle. The main pulse is one pulse, which is substantially the same as shown in FIG. 9A, for causing the nozzle 22 to discharge a small-sized ink droplet therefrom. The cancellation pulse has a pulse width (T/2) half as long as the pulse width T of the main pulse. For instance, when the cancellation pulse is applied to the second actuator in the individual driving process, the residual vibrations in the second pressure chamber 21*b* is cancelled. The number of the main pulses may be changed depending on the size of an ink droplet to be discharged.

Figure 9C:
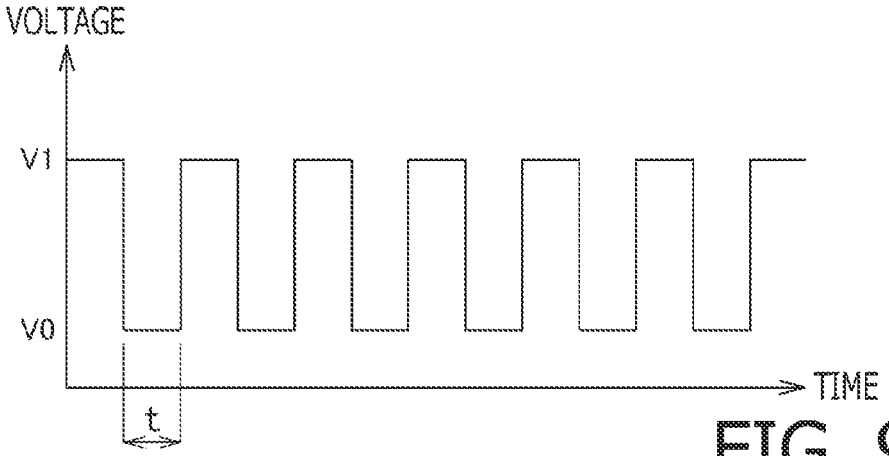
FIG. 9C shows an example of a non-discharge drive signal for an actuator included in the head, in the third illustrative embodiment according to one or more aspects of the present disclosure.

FIG. 9C shows an example of the non-discharge drive signal, which has a plurality of pulses that appear repeatedly in short cycles (e.g., a cycle of 8 μm) within one recording cycle. Preferably, in this case, each pulse may have a pulse width t less than one-third of the AL.

The controller 5 has a ROM that stores data representing various types of drive signals. The various types of drive signals, stored in the ROM of the controller 5, include the discharge drive signal for small-sized ink droplets as shown in FIG. 9A, the cancellation drive signal for small-sized ink droplets as shown in FIG. 9B, and the non-discharge drive signal as shown in FIG. 9C. In addition, the various types of drive signals stored in the ROM further include a discharge drive signal for medium-sized ink droplets, a cancellation drive signal for medium-sized ink droplets, a discharge drive signal for large-sized ink droplets, a cancellation drive signal for large-sized ink droplets, and a drive signal for no ink droplets to be discharged. In the individual driving process, the controller 5 provides the first actuator with one of the various types of drive signals stored in the ROM and provides the second actuator with another one of the various types of drive signals, based on a recording command (including image data) input from an external device such as a PC.

As described above, according to the third illustrative embodiment, to discharge the ink from the nozzle 22 (see FIG. 4), the controller 5 selectively performs the in-phase driving process and the individual driving process. In the in-phase driving process, the controller 5 provides in-phase drive signals to the actuator 12*x*1 (i.e., the first actuator) that overlaps with the first pressure chamber 21*a* when viewed in the second direction and the actuator 12*x*2 (i.e., the second actuator) that overlaps with the second pressure chamber 21*b* when viewed in the second direction. In the individual driving process, the controller 5 provides respective different drive signals to the first actuator and the second actuator. Thus, in the third illustrative embodiment, it is possible to more flexibly design waveforms of the drive signals. Thereby, for instance, execution of the individual driving process makes it possible to cancel residual vibrations in a corresponding one of the pressure chambers 21*a* and 21*b* (see FIG. 9B) or prevent ink in the nozzle 22 from being thickened (see FIG. 9C).

For instance, in the individual driving process, the controller 5 may provide the first actuator with the discharge drive signal (see FIG. 9A) to cause the nozzle 22 to discharge the ink therefrom, and may provide the second actuator with the cancellation drive signal (see FIG. 9B) to cancel residual vibrations (e.g., vibrations remaining in a corresponding one of the pressure chambers 21*a* and 21*b*). In this case, the execution of the individual driving process makes it possible to cancel the residual vibrations.

In another instance, in the individual driving process, the controller 5 may provide the first actuator with the discharge drive signal (see FIG. 9A) to cause the nozzle 22 to discharge the ink therefrom, and may provide the second actuator with the non-discharge drive signal (see FIG. 9C) to vibrate a meniscus of ink formed in the nozzle 22 without discharging the ink from the nozzle 22. In this case, the execution of the individual driving process makes it possible to prevent ink in the nozzle 22 from being thickened.

Fourth Illustrative Embodiment

Figure 10:
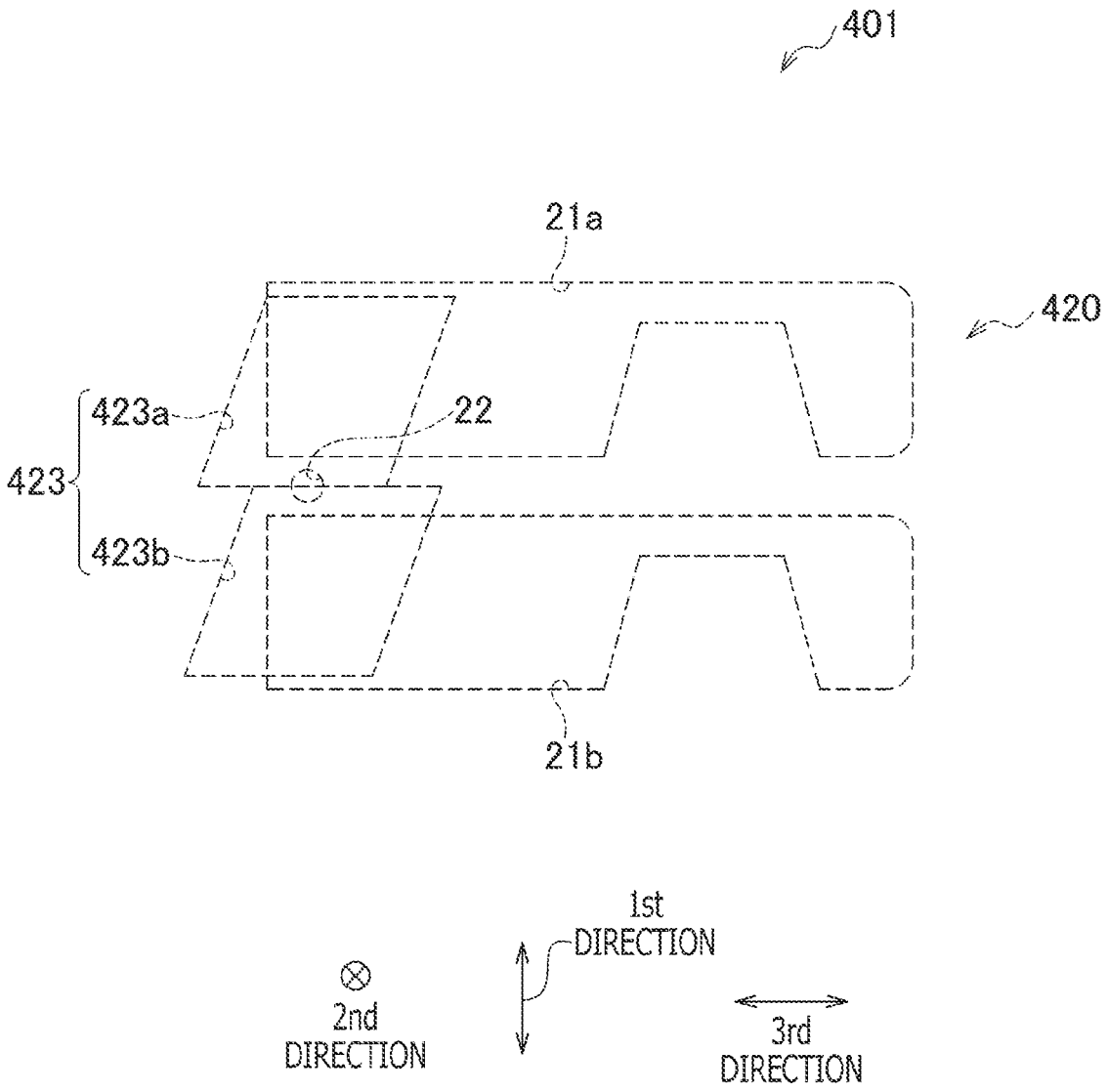
FIG. 10 is a plan view schematically showing a configuration of each individual flow channel included in each head of a printer, in a fourth illustrative embodiment according to one or more aspects of the present disclosure.

Subsequently, a fourth illustrative embodiment according to aspects of the present disclosure will be described with reference to FIG. 10.

In the aforementioned first illustrative embodiment (see FIG. 2), each connection flow channel 23 has a rectangular shape in a plane orthogonal to the second direction. On the other hand, in the fourth illustrative embodiment (see FIG. 10), a connection flow channel 423 included in each individual flow channel 420 includes two portions 423*a* and 423*b* each of which has a parallelogram shape in a plane orthogonal to the second direction.

Specifically, in a head 401 of the fourth illustrative embodiment, the connection flow channel 423 of each individual flow channel 420 has a first portion 423*a* and a second portion 423*b*. The first portion 423*a* is formed to, when viewed in the second direction, overlap with the first pressure chamber 21*a* and have a parallelogram shape. The second portion 423*b* is formed to, when viewed in the second direction, overlap with the second pressure chamber 21*b* and have a parallelogram shape. The first portion 423*a* and the second portion 423*b* are arranged side by side along the first direction and are in contact with each other in the first direction. Each of the first and second portions 423*a* and 423*b* has two sides extending along the third direction. One of the two sides of the first portion 423*a* overlaps with one of the two sides of the second portion 423*b*, just above the nozzle 22.

In the fourth illustrative embodiment, a plate forming the connection flow channel 423 is made of Si (silicon).

The fourth illustrative embodiment takes into account characteristics (e.g., dependence of an etching rate on crystal plane orientations) of anisotropic wet etching of Si (silicon). Specifically, even when wet etching is employed instead of dry etching to reduce a manufacturing cost, the connection flow channel 423 is formed by the two portions 423*a* and 423*b* each having the parallelogram shape. Therefore, the connection flow channel 423 is easy to form. In other words, it is possible to inexpensively form the connection flow channel 423 of each individual flow channel 420.

Hereinabove, the illustrative embodiments according to aspects of the present disclosure have been described. Aspects of the present disclosure may be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that aspects of the present disclosure may be practiced without reapportioning to the details specifically set forth. In other instances, well known processing structures have not been described in detail, in order not to unnecessarily obscure the present disclosure.

Only exemplary illustrative embodiments of the present disclosure and but a few examples of their versatility are shown and described in the present disclosure. It is to be understood that aspects of the present disclosure are capable of use in various other combinations and environments and are capable of changes or modifications within the scope of the inventive concept as expressed herein. For instance, the following modifications may be feasible.

<Modifications>

According to aspects of the present disclosure, for instance, an expression "a connection flow channel of each individual flow channel extends along the second direction from one end to the other end of the connection flow channel in the second direction" may not necessarily be interpreted limitedly as the extending direction of the connection flow channel is parallel to the second direction. Even when such an expression is used, the extending direction of the connection flow channel may not be strictly parallel to the second direction but may intersect the second direction.

According to aspects of the present disclosure, a connection flow channel of each individual flow channel may not necessarily extend along the second direction from one end to the other end thereof in the second direction, as long as the connection flow channel communicates with a first pressure chamber, a second pressure chamber, and a nozzle, and does not communicate with anything other than the first pressure chamber, the second pressure chamber, and the nozzle. For instance, in a modification (see FIG. 11) according to aspects of the present disclosure, in a head 1', a connection flow channel 23' does not extend along the second direction from one end (i.e., a first end) to the other end (i.e., a second end) thereof in the second direction. The connection flow channel 23' has a first connection section 23*a* connected with a first pressure chamber 21*a*, a second connection section 23*b* connected with a second pressure chamber 21*b*. and an extended section 23*c* that connects the first connection section 23*a* with the second connection section 23*b* and extends downward. The first connection section 23*a* is separated from the second connection section 23*b* by a partition wall W in the first direction. The first connection section 23*a* extends downward from the first pressure chamber 21*a*. The second connection section 23*b* extends downward from the second pressure chamber 21*b*. The extended section 23*c* connects the first connection section 23*a* and the second connection section 23*b* at an upper end of the extended section 23*c*. Further, the extended section 23*c* communicates with the nozzle 22 at a lower end of the extended section 23*c*. Upper ends of the connection sections 23*a* and 23*b* are first ends 23*x*1' and 23*x*2' of the connection flow channel 23' in the second direction, respectively. A lower end of the extended section 23*c* is a second end 23*y'* of the connection flow channel 23' in the second direction. In another instance, the partition wall W shown in FIG. 11 may be omitted, and the connection flow channel 23' may be T-shaped. In this case, a combined portion of the two connection sections 23*a* and 23*b* may communicate with both of the two pressure chambers 21*a* and 21*b*.

In the aforementioned first illustrative embodiment (see FIG. 6), the wire 12*e* of the actuator substrate 12 electrically connects the individual electrodes 12*d*1 and 12*d*2 with each other. However, the individual electrodes 12*d*1 and 12*d*2 themselves may be partially and physically connected, thereby being electrically connected with each other without the wire 12*e*.

In the aforementioned first illustrative embodiment (see FIG. 4), an individual electrode is provided for each of the pressure chambers 21*a* and 21*b*. However, a single individual electrode may be provided for the two pressure chambers 21*a* and 21*b*.

The nozzle 22 may not necessarily be located in the center between the first pressure chamber 21*a* and the second pressure chamber 21*b* in the first direction. The nozzle 22 may be located in a position away from the said center in the first direction.

In the aforementioned first illustrative embodiment (see FIG. 2), the centerline O of each of the narrow flow channels 24*a* and 24*b* in the first direction does not coincide, in the first direction, with the centerline O' of a corresponding one of the pressure chambers 21*a* and 21*b* in the first direction. However, the centerline O of each of the narrow flow channels 24*a* and 24*b* in the first direction may coincide, in the first direction, with the centerline O' of a corresponding one of the pressure chambers 21*a* and 21*b* in the first direction. Further, the relative position of each narrow flow channel 24*a* with respect to the corresponding first pressure chamber 21*a* in the first direction may be different from the relative position of each narrow flow channel 24*b* with respect to the corresponding second pressure chamber 21*b* in the first direction.

In the connection flow channel 23 (see FIG. 4) of each individual flow channel 20, the angle θ formed between each side wall 11*c*1 and the bottom wall 11*d*1 is not limited to an obtuse angle, but may be a right angle. Further, the angle θ formed between one of the two side walls 11*c*1 and the bottom wall 11*d*1 may be different from the angle θ formed between the other of the two side walls 11*c*1 and the bottom wall 11*d*1.

In each individual flow channel 20, the side walls 11*b*2 (see FIGS. 4 and 5) of the pressure chambers 21*a* and 21*b* may have a fixed thickness in the third direction.

In the individual driving process, the controller 5 may not necessarily provide the first actuator with the discharge drive signal (see FIG. 9A) and provide the second actuator with the cancellation drive signal (see FIG. 9B) or the non-discharge drive signal (see FIG. 9C). In other words, in the individual driving process, the controller 5 may provide the first actuator with a first arbitrary drive signal and provide the second actuator with a second arbitrary drive signal, as long as the first arbitrary drive signal and the second arbitrary drive signal are different from each other within the same recording cycle. For instance, the controller 5 may provide the first actuator with a first discharge drive signal including a single pulse and provide the second actuator with a second discharge drive signal including two pulses.

The number of the individual flow channel groups (e.g., 20A and 20B), each of which includes a plurality of individual flow channels 20 arranged along the first direction, is not limited to two, but may an arbitrary number. For instance, the number of the individual flow channel groups may be three or more.

In the aforementioned illustrative embodiments, each individual flow channel 20 includes a single nozzle 22. However, each individual flow channel 20 may include two or more nozzles 22.

A liquid discharge head (e.g., the head 1) according to aspects of the present disclosure is not limited to a line type head, but may be of a serial type to discharge liquid from nozzles onto a discharge target while moving in a scanning direction parallel to the sheet width direction.

Examples of the discharge target may include, but are not limited to, paper, cloth, and a substrate.

The liquid to be discharged from the nozzles 22 is not limited to ink, but may be other arbitrary liquid such as process liquid for agglutinating or precipitating a component in ink.

Aspects of the present disclosure may be applied not only to printers but also to facsimile machines, copying machines, multi-function peripherals, and the like. In addition, aspects of the present disclosure are also applicable to a liquid discharge device (e.g., a liquid discharge device that discharges conductive liquid onto a substrate to form a conductive pattern) used for applications other than image recording.

The following shows examples of associations between elements exemplified in the aforementioned illustrative embodiments and modifications and elements according to aspects of the present disclosure. The printer 100 may be an example of a "liquid discharge device" according to aspects of the present disclosure. Each of the heads 1 included in the printer 100 may be an example of a "liquid discharge head" according to aspects of the present disclosure. Each of the common flow channels 31 and 32 included in each head 1 may be an example of a "common flow channel" according to aspects of the present disclosure. The plurality of individual flow channels 20 of each head 1 may be included in examples of "a plurality of individual flow channels" according to aspects of the present disclosure. The first pressure chamber 21*a* of each individual flow channel 20 may be an example of a "first pressure chamber" according to aspects of the present disclosure. The second pressure chamber 21*b* of each individual flow channel 20 may be an example of a "second pressure chamber" according to aspects of the present disclosure. The nozzle 22 of each individual flow channel 20 may be an example of a "nozzle" according to aspects of the present disclosure. The connection flow channel 23 of each individual flow channel 20 may be an example of a "connection flow channel" according to aspects of the present disclosure. The one end 23*x* of the connection flow channel 23 in the second direction may be an example of a "first end" of the "connection flow channel" in a "second direction" according to aspects of the present disclosure. The other end 23*y* of the connection flow channel 23 in the second direction may be an example of a "second end" of the "connection flow channel" in the "second direction" according to aspects of the present disclosure. The actuator 12*x*1 for each individual flow channel 20 may be an example of a "first actuator" according to aspects of the present disclosure. The actuator 12*x*2 for each individual flow channel 20 may be an example of a "second actuator" according to aspects of the present disclosure. The controller 5 may be an example of a "controller" according to aspects of the present disclosure. The flow channel substrate 11 of each head 1 may be an example of a "flow channel substrate" according to aspects of the present disclosure. The actuator substrate 12 of each head 1 may be an example of an "actuator substrate" according to aspects of the present disclosure. The circuit board 18 of each head 1 may be an example of a "circuit board" according to aspects of the present disclosure. The narrow flow channel 24*a* of each individual flow channel 20 may be an example of a "first communication flow channel" according to aspects of the present disclosure. The narrow flow channel 24*b* of each individual flow channel 20 may be an example of a "second communication flow channel" according to aspects of the present disclosure. The side wall 11*b*2 for defining the first pressure chamber 21*a* of each individual flow channel 20 may be an example of a "first side wall" according to aspects of the present disclosure. The side wall 11*b*2 for defining the second pressure chamber 21*b* of each individual flow channel 20 may be an example of a "second side wall" according to aspects of the present disclosure. The individual electrode 12*d*1 for each individual flow channel 20 may be an example of a "first electrode" according to aspects of the present disclosure. The individual electrode 12*d*2 for each individual flow channel 20 may be an example of a "second electrode" according to aspects of the present disclosure. The contact 12*f* may be an example of a "connecting section" according to aspects of the present disclosure.

What is claimed is:

1. A liquid discharge head comprising:

a common flow channel extending along a first direction; and a plurality of individual flow channels arranged along the first direction, each individual flow channel comprising:

a first pressure chamber and a second pressure chamber arranged along the first direction, each of the first and second pressure chambers communicating with the common flow channel;

a nozzle located away from the first pressure chamber and the second pressure chamber in a second direction orthogonal to the first direction; and a connection flow channel configured to connect the first pressure chamber, the second pressure chamber, and the nozzle with each other, the connection flow channel having a first end and a second end in the second direction, the first end of the connection flow channel in the second direction communicating with the first pressure chamber and the second pressure chamber, the second end of the connection flow channel in the second direction communicating with the nozzle, the connection flow channel extending along the second direction from the first end to the second end thereof in the second direction.

2. The liquid discharge head according to claim 1, further comprising:

a flow channel substrate having the plurality of individual flow channels formed thereon;

an actuator substrate attached to the flow channel substrate, the actuator substrate including, for each individual flow channel:

a first electrode overlapping with the first pressure chamber when viewed in the second direction;

a second electrode overlapping with the second pressure chamber when viewed in the second direction; and a connecting section connecting the first electrode and the second electrode with each other; and a circuit board attached to the actuator substrate, the circuit board including an individual wire provided for each individual flow channel, the individual wire being connected with the connecting section.

3. The liquid discharge head according to claim 1, further comprising:

a flow channel substrate having the plurality of individual flow channels formed thereon;

an actuator substrate attached to the flow channel substrate, the actuator substrate including, for each individual flow channel:

a first electrode overlapping with the first pressure chamber when viewed in the second direction; and a second electrode overlapping with the second pressure chamber when viewed in the second direction; and a circuit board attached to the actuator substrate, the circuit board including a wire provided for each individual flow channel, the wire having:

a first portion connected with the first electrode;

a second portion connected with the second electrode and the first portion; and a third portion extending from a connecting portion between the first portion and the second portion.

4. The liquid discharge head according to claim 1, wherein the nozzle is located substantially in a center between the first pressure chamber and the second pressure chamber in the first direction.

5. The liquid discharge head according to claim 1, wherein each of the plurality of individual flow channels further comprises:

a first communication flow channel configured to communicate the common flow channel and the first pressure chamber with each other, the first communication flow channel being disposed side by side with the first pressure chamber in a third direction orthogonal to the first direction and the second direction, the first communication flow channel having a width shorter than a length of the first pressure chamber in the first direction; and a second communication flow channel configured to communicate the common flow channel and the second pressure chamber with each other, the second communication flow channel being disposed side by side with the second pressure chamber in the third direction, the second communication flow channel having a width shorter than a length of the second pressure chamber in the first direction, and wherein a relative position of the first communication flow channel with respect to the first pressure chamber in the first direction is substantially equivalent to a relative position of the second communication flow channel with respect to the second pressure chamber in the second direction.

6. The liquid discharge head according to claim 1, wherein the connection flow channel is defined by two side walls and a bottom wall in a cross section along the first direction and the second direction, wherein the two side walls are formed to sandwich the connection flow channel therebetween in the first direction, wherein the bottom wall is orthogonal to the second direction at the second end of the connection flow channel in the second direction, and wherein an angle formed between each side wall and the bottom wall is obtuse.

7. The liquid discharge head according to claim 1, wherein the first pressure chamber is defined by a partition wall and a first side wall, the partition wall separating the first pressure chamber from the second pressure chamber in the first direction, the first side wall being spaced apart from the partition wall in the first direction, the first pressure chamber being sandwiched between the partition wall and the first side wall in the first direction, wherein the second pressure chamber is defined by the partition wall and a second side wall, the second side wall being spaced apart from the partition wall in the first direction, the second pressure chamber being sandwiched between the partition wall and the second side wall in the first direction, wherein each of the first side wall and the second side wall has a bonding portion, each bonding portion being bonded with a corresponding one of two side walls that define the connection flow channel and sandwich the connection flow channel therebetween in the first direction, and wherein a thickness of the bonding portion in the first direction is greater than a thickness, in the first direction, of a portion other than the bonding portion in each of the first and second side walls.

8. The liquid discharge head according to claim 1, wherein the first pressure chamber is defined by a partition wall and a first side wall, the partition wall separating the first pressure chamber from the second pressure chamber in the first direction, the first side wall being spaced apart from the partition wall in the first direction, the first pressure chamber being sandwiched between the partition wall and the first side wall in the first direction, wherein the second pressure chamber is defined by the partition wall and a second side wall, the second side wall being spaced apart from the partition wall in the first direction, the second pressure chamber being sandwiched between the partition wall and the second side wall in the first direction, wherein each of the first side wall and the second side wall has a bonding portion, each bonding portion being bonded with a corresponding one of two side walls that define the connection flow channel and sandwich the connection flow channel therebetween in the first direction, and wherein a thickness, in the first direction, of a portion bonded with the bonding portion in each of the two side walls is greater than a thickness of the bonding portion in the first direction, wherein a length, in the first direction, of the first end of the connection flow channel in the second direction is shorter than a length in the first direction from a surface of the first side wall that is in contact with the first pressure chamber to a surface of the second side wall that is in contact with the second pressure chamber.

9. The liquid discharge head according to claim 1, wherein the connection flow channel includes:

a first portion formed to, when viewed in the second direction, overlap with the first pressure chamber and have a parallelogram shape; and a second portion formed to, when viewed in the second direction, overlap with the second pressure chamber and have a parallelogram shape, the second portion being in contact with the first portion in the first direction.

10. A liquid discharge head comprising:

a common flow channel extending along a first direction; and a plurality of individual flow channels arranged along the first direction, each individual flow channel comprising:

a first pressure chamber and a second pressure chamber arranged along the first direction, each of the first and second pressure chambers communicating with the common flow channel;

a nozzle located away from the first pressure chamber and the second pressure chamber in a second direction orthogonal to the first direction; and a connection flow channel configured to connect the first pressure chamber, the second pressure chamber, and the nozzle with each other, the connection flow channel having a first end and a second end in the second direction, the first end of the connection flow channel in the second direction communicating with the first pressure chamber and the second pressure chamber, the second end of the connection flow channel in the second direction communicating with the nozzle, the connection flow channel being further configured to communicate with nothing other than the first pressure chamber, the second pressure chamber, and the nozzle.

11. The liquid discharge head according to claim 10, further comprising:

a flow channel substrate having the plurality of individual flow channels formed thereon;

an actuator substrate attached to the flow channel substrate, the actuator substrate including, for each individual flow channel:

a first electrode overlapping with the first pressure chamber when viewed in the second direction;

a second electrode overlapping with the second pressure chamber when viewed in the second direction; and a connecting section connecting the first electrode and the second electrode with each other; and a circuit board attached to the actuator substrate, the circuit board including an individual wire provided for each individual flow channel, the individual wire being connected with the connecting section.

12. The liquid discharge head according to claim 10, further comprising:

a flow channel substrate having the plurality of individual flow channels formed thereon;

an actuator substrate attached to the flow channel substrate, the actuator substrate including, for each individual flow channel:

a first electrode overlapping with the first pressure chamber when viewed in the second direction; and a second electrode overlapping with the second pressure chamber when viewed in the second direction; and a circuit board attached to the actuator substrate, the circuit board including a wire provided for each individual flow channel, the wire having:

a first portion connected with the first electrode;

a second portion connected with the second electrode and the first portion; and a third portion extending from a connecting portion between the first portion and the second portion.

13. The liquid discharge head according to claim 10, wherein the nozzle is located substantially in a center between the first pressure chamber and the second pressure chamber in the first direction.

14. The liquid discharge head according to claim 10, wherein each of the plurality of individual flow channels further comprises:

a first communication flow channel configured to communicate the common flow channel and the first pressure chamber with each other, the first communication flow channel being disposed side by side with the first pressure chamber in a third direction orthogonal to the first direction and the second direction, the first communication flow channel having a width shorter than a length of the first pressure chamber in the first direction; and a second communication flow channel configured to communicate the common flow channel and the second pressure chamber with each other, the second communication flow channel being disposed side by side with the second pressure chamber in the third direction, the second communication flow channel having a width shorter than a length of the second pressure chamber in the first direction, and wherein a relative position of the first communication flow channel with respect to the first pressure chamber in the first direction is substantially equivalent to a relative position of the second communication flow channel with respect to the second pressure chamber in the second direction.

15. The liquid discharge head according to claim 10, wherein the connection flow channel is defined by two side walls and a bottom wall in a cross section along the first direction and the second direction, wherein the two side walls are formed to sandwich the connection flow channel therebetween in the first direction, wherein the bottom wall is orthogonal to the second direction at the second end of the connection flow channel in the second direction, and wherein an angle formed between each side wall and the bottom wall is obtuse.

16. The liquid discharge head according to claim 10, wherein the first pressure chamber is defined by a partition wall and a first side wall, the partition wall separating the first pressure chamber from the second pressure chamber in the first direction, the first side wall being spaced apart from the partition wall in the first direction, the first pressure chamber being sandwiched between the partition wall and the first side wall in the first direction, wherein the second pressure chamber is defined by the partition wall and a second side wall, the second side wall being spaced apart from the partition wall in the first direction, the second pressure chamber being sandwiched between the partition wall and the second side wall in the first direction, wherein each of the first side wall and the second side wall has a bonding portion, each bonding portion being bonded with a corresponding one of two side walls that define the connection flow channel and sandwich the connection flow channel therebetween in the first direction, and wherein a thickness of the bonding portion in the first direction is greater than a thickness, in the first direction, of a portion other than the bonding portion in each of the first and second side walls.

17. The liquid discharge head according to claim 10, wherein the first pressure chamber is defined by a partition wall and a first side wall, the partition wall separating the first pressure chamber from the second pressure chamber in the first direction, the first side wall being spaced apart from the partition wall in the first direction, the first pressure chamber being sandwiched between the partition wall and the first side wall in the first direction, wherein the second pressure chamber is defined by the partition wall and a second side wall, the second side wall being spaced apart from the partition wall in the first direction, the second pressure chamber being sandwiched between the partition wall and the second side wall in the first direction, wherein each of the first side wall and the second side wall has a bonding portion, each bonding portion being bonded with a corresponding one of two side walls that define the connection flow channel and sandwich the connection flow channel therebetween in the first direction, and wherein a thickness, in the first direction, of a portion bonded with the bonding portion in each of the two side walls is greater than a thickness of the bonding portion in the first direction, wherein a length, in the first direction, of the first end of the connection flow channel in the second direction is shorter than a length in the first direction from a surface of the first side wall that is in contact with the first pressure chamber to a surface of the second side wall that is in contact with the second pressure chamber.

18. The liquid discharge head according to claim 10, wherein the connection flow channel includes:

a first portion formed to, when viewed in the second direction, overlap with the first pressure chamber and have a parallelogram shape; and a second portion formed to, when viewed in the second direction, overlap with the second pressure chamber and have a parallelogram shape, the second portion being in contact with the first portion in the first direction.

19. A liquid discharge device comprising:

a common flow channel extending along a first direction;

a plurality of individual flow channels arranged along the first direction, each individual flow channel comprising:

a first pressure chamber and a second pressure chamber arranged along the first direction, each of the first and second pressure chambers communicating with the common flow channel;

a nozzle located away from the first pressure chamber and the second pressure chamber in a second direction orthogonal to the first direction; and a connection flow channel configured to connect the first pressure chamber, the second pressure chamber, and the nozzle with each other, the connection flow channel having a first end and a second end in the second direction, the first end of the connection flow channel in the second direction communicating with the first pressure chamber and the second pressure chamber, the second end of the connection flow channel in the second direction communicating with the nozzle, the connection flow channel extending along the second direction from the first end to the second end thereof in the second direction;

a first actuator disposed to overlap with the first pressure chamber of each individual flow channel when viewed in the second direction;

a second actuator disposed to overlap with the second pressure chamber of each individual flow channel when viewed in the second direction; and a controller configured to perform an in-phase driving process to provide in-phase drive signals to the first actuator and the second actuator, when causing the nozzle to discharge liquid therefrom.

20. The liquid discharge device according to claim 19, wherein the controller is further configured to selectively perform one of the in-phase driving process and an individual driving process, when causing the nozzle to discharge the liquid therefrom, and wherein, in the individual driving process, the controller provides respective different drive signals to the first actuator and the second actuator.

21. The liquid discharge device according to claim 20, wherein, in the individual driving process, the controller provides the first actuator with a discharge drive signal to cause the nozzle to discharge the liquid, and provides the second actuator with a cancellation drive signal to cancel residual vibrations.

22. The liquid discharge device according to claim 20, wherein, in the individual driving process, the controller provides the first actuator with a discharge drive signal to cause the nozzle to discharge the liquid, and provides the second actuator with a non-discharge drive signal to vibrate a meniscus of the liquid formed in the nozzle without discharging the liquid from the nozzle.

23. A liquid discharge device comprising:

a common flow channel extending along a first direction;

a plurality of individual flow channels arranged along the first direction, each individual flow channel comprising:

a first pressure chamber and a second pressure chamber arranged along the first direction, each of the first and second pressure chambers communicating with the common flow channel;

a nozzle located away from the first pressure chamber and the second pressure chamber in a second direction orthogonal to the first direction; and a connection flow channel configured to connect the first pressure chamber, the second pressure chamber, and the nozzle with each other, the connection flow channel having a first end and a second end in the second direction, the first end of the connection flow channel in the second direction communicating with the first pressure chamber and the second pressure chamber, the second end of the connection flow channel in the second direction communicating with the nozzle, the connection flow channel being further configured to communicate with nothing other than the first pressure chamber, the second pressure chamber, and the nozzle;

a first actuator disposed to overlap with the first pressure chamber of each individual flow channel when viewed in the second direction;

a second actuator disposed to overlap with the second pressure chamber of each individual flow channel when viewed in the second direction; and a controller configured to perform an in-phase driving process to provide in-phase drive signals to the first actuator and the second actuator, when causing the nozzle to discharge liquid therefrom.

24. The liquid discharge device according to claim 23, wherein the controller is further configured to selectively perform one of the in-phase driving process and an individual driving process, when causing the nozzle to discharge the liquid therefrom, and wherein, in the individual driving process, the controller provides respective different drive signals to the first actuator and the second actuator.

25. The liquid discharge device according to claim 24, wherein, in the individual driving process, the controller provides the first actuator with a discharge drive signal to cause the nozzle to discharge the liquid, and provides the second actuator with a cancellation drive signal to cancel residual vibrations.

26. The liquid discharge device according to claim 24, wherein, in the individual driving process, the controller provides the first actuator with a discharge drive signal to cause the nozzle to discharge the liquid, and provides the second actuator with a non-discharge drive signal to vibrate a meniscus of the liquid formed in the nozzle without discharging the liquid from the nozzle.

* * * * *